United States Patent [19]

Odom et al.

[11] 4,133,254

[45] Jan. 9, 1979

[54] CASE OPENER AND BOTTOM SEALER

[75] Inventors: Robert E. Odom, Blaine; Gaylerd M. Lieder, Minneapolis, both of Minn.

[73] Assignee: Bemis Company, Inc., Minneapolis, Minn.

[21] Appl. No.: 709,225

[22] Filed: Jul. 27, 1976

[51] Int. Cl.[2] ..... B31B 1/80

[52] U.S. Cl. ..... 93/53 SD; 271/150; 93/49 R

[58] Field of Search ..... 93/36.3, 49 R, 53 R, 93/53 SD, 53 M, 53 AC; 271/3.1, 30 R, 147, 150

[56] References Cited

U.S. PATENT DOCUMENTS

| | | | |
|---|---|---|---|
| Re. 27,631 | 5/1973 | Berney | 93/53 R |
| 3,226,109 | 12/1965 | Thompson et al. | 271/150 X |
| 3,477,349 | 11/1969 | Berney | 93/53 R |
| 3,608,440 | 9/1971 | Reichert et al. | 93/36.3 |
| 3,620,138 | 11/1971 | Neol et al. | 93/36.3 |
| 3,776,544 | 12/1973 | Watson et al. | 271/3.1 |

*Primary Examiner*—Roy Lake

*Assistant Examiner*—Paul A. Bell

*Attorney, Agent, or Firm*—Clayton R. Johnson

[57] ABSTRACT

A case opener and bottom sealer machine that includes a frame, a conveyor assembly on the frame for stacks of flat folded case blanks, a lift assembly on the frame that includes suction cups for grippingly engaging the uppermost blank of the adjacent stack and elevating the gripped blank, longitudinally elongated rails on the frame for supporting a blank in an erect condition as it is moved therealong, a case erect assembly mounted on the frame for opening the gripped blank to an erect condition and after the erect blank is released by the cups move the erect blank along the rails, folder mechanism for folding the minor flaps at one end of the erect blank and thence partially fold the major flaps of the erect blank, a glue device for applying glue to the folded minor flaps, a compression assembly for completing the folding of the major flaps and holding the folded flaps under compression to provide a good seal, and controls for automatically operating the conveyor, erect, and compression assemblies and the glue device.

46 Claims, 14 Drawing Figures

17
25
36
37
46
47
48
52
53
54
56
58
59
61
63
64
65
66
67
71
96
112
113
114
115
117
118
122
130
131
132
133
134
136
153
154
158a
158b
175
188
190
194
195
198
201
206
207
208

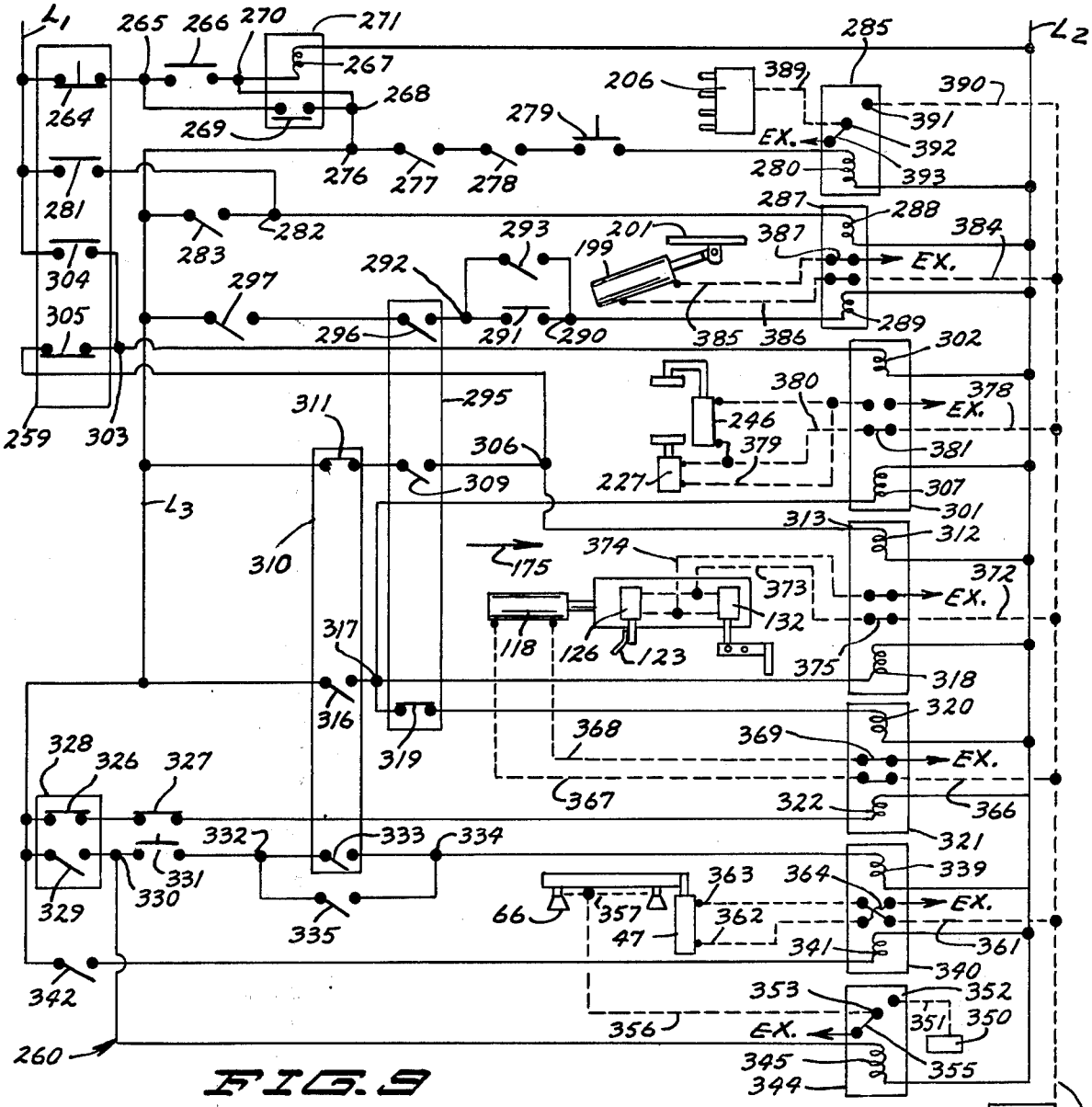
FIG. 9
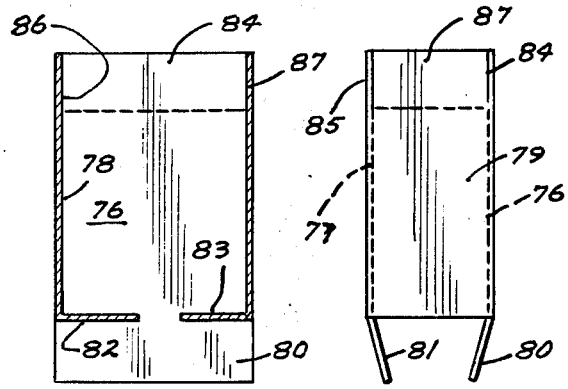
FIG. 12 FIG. 13
FIG. 10
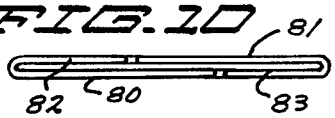
FIG. 11
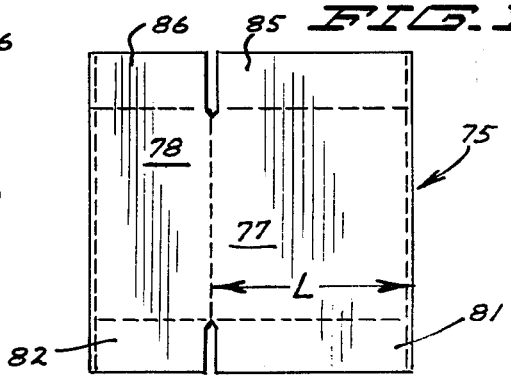

CASE OPENER AND BOTTOM SEALER

BACKGROUND OF THE INVENTION

A machine for closing and sealing the bottom of a case.

In the prior art in forming cases having sealed bottoms from flat folded case blanks there has been a problem in that conventional apparatus requires more space than desired and is not readily adjustable for processing different size cases. Further, prior art machines of this general type have been relatively hard to load and to clean up a jam up in the magazine portions thereof. This invention has been made to provide a relatively short machine for both opening a flat folded case blank and forming a sealed bottom closure, and that is readily adjustable for different size cases.

SUMMARY OF THE INVENTION

A case opener and bottom sealer machine that includes a case elevating assembly and an erect assembly for elevating a flat folded case blank and opening the elevated blank to an erect condition, support mechanism for supporting the erected case as the case is moved forwardly to a compression station, said erect assembly being mounted for movement to move the erected case along the support mechanism to the compression station, folder mechanism for folding the case flaps at one end thereof, a compression assembly for compressing the flaps at the one end of the case to firmly adhere the minor and major flaps together, and an adhesive applying device for applying adhesive to flaps at the case one end prior to the flaps being compressed.

One of the objects of this invention is to provide a new and novel machine of a relatively short length for opening a flat folded case and forming a sealed bottom closure. Another object of this invention is to provide new and novel means for elevating a flat folded case and opening the case to have joined pairs of side walls extend at substantially right angles to one another. A further object of this invention is to provide new and novel means for supporting an erected case after the case has been vertically elevated and at a time prior to the case being moved horizontally away from its initial elevated position. A still further object of this invention is to provide new and novel means for folding the flaps at one end of a case to a case bottom closure position.

An additional object of this invention is to provide in a case feeding and folding machine, new and novel magazine and case blank removing means that permits easier loading of the magazine and cleaning up after any jam ups. A still further object of this invention is to provide new and novel case folding mechanism in a case folding machine to avoid overlap of opposed major flaps to have the terminal edges of the major flaps in abutting relationship or parallel to one another.

BRIEF DESCRIPTION OF THE DRAWINGS

FIG. 1 is a plan view of the apparatus of the invention with the tucker, erect carriage and compression cylinders in retracted position, portions of said apparatus being broken away to more clearly illustrate structure therebeneath and only a portion of the conveyor assembly being shown;

FIG. 4 is the front view of the apparatus of this invention generally taken along the line and in the direction of the arrows 4—4 of FIG. 1;

FIG. 9 is a simplified diagrammatic illustration of the pneumatic and electrical circuitry and components of the apparatus of this invention;

FIG. 10 is an end view of a case blank in a flat folded condition;

FIG. 11 is a plan view of the case blank in the condition of FIG. 10;

FIG. 12 is a horizontal cross-sectional view of a carton blank in an erected condition with the minor end flaps at one end folded inwardly;

FIG. 13 is an end view of the case blank in the condition illustrated in FIG. 12; and FIG. 14 is a fragmentary side view of the stop latch mechanism that aids in retaining the open case in a squared condition at the flap compression station.

Figure 7:
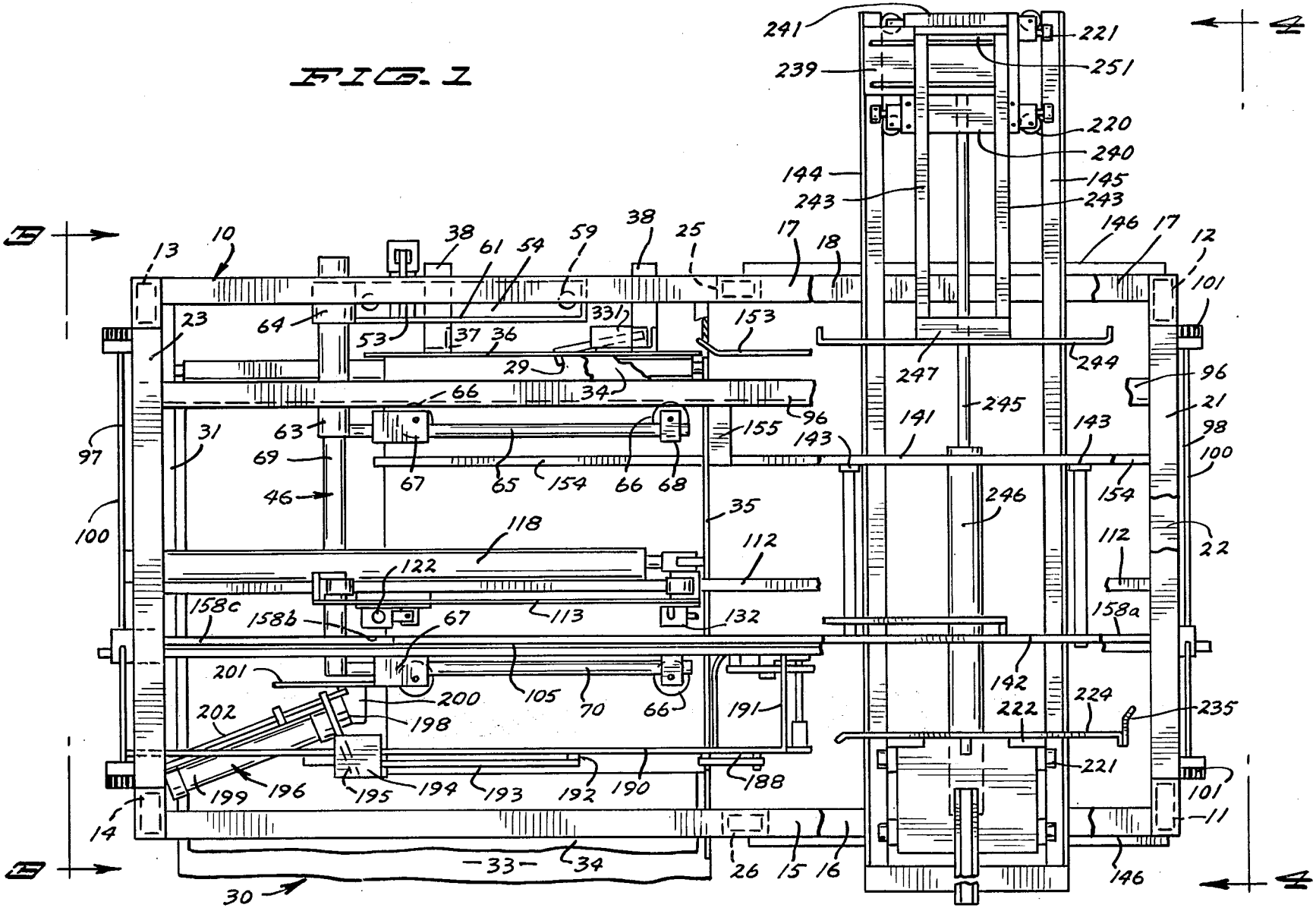
FIG. 7 is a fragmentary, horizontal view generally taken along the line and in the direction of the arrows 7—7 of FIG. 6, portions being broken away.
Figure 2:
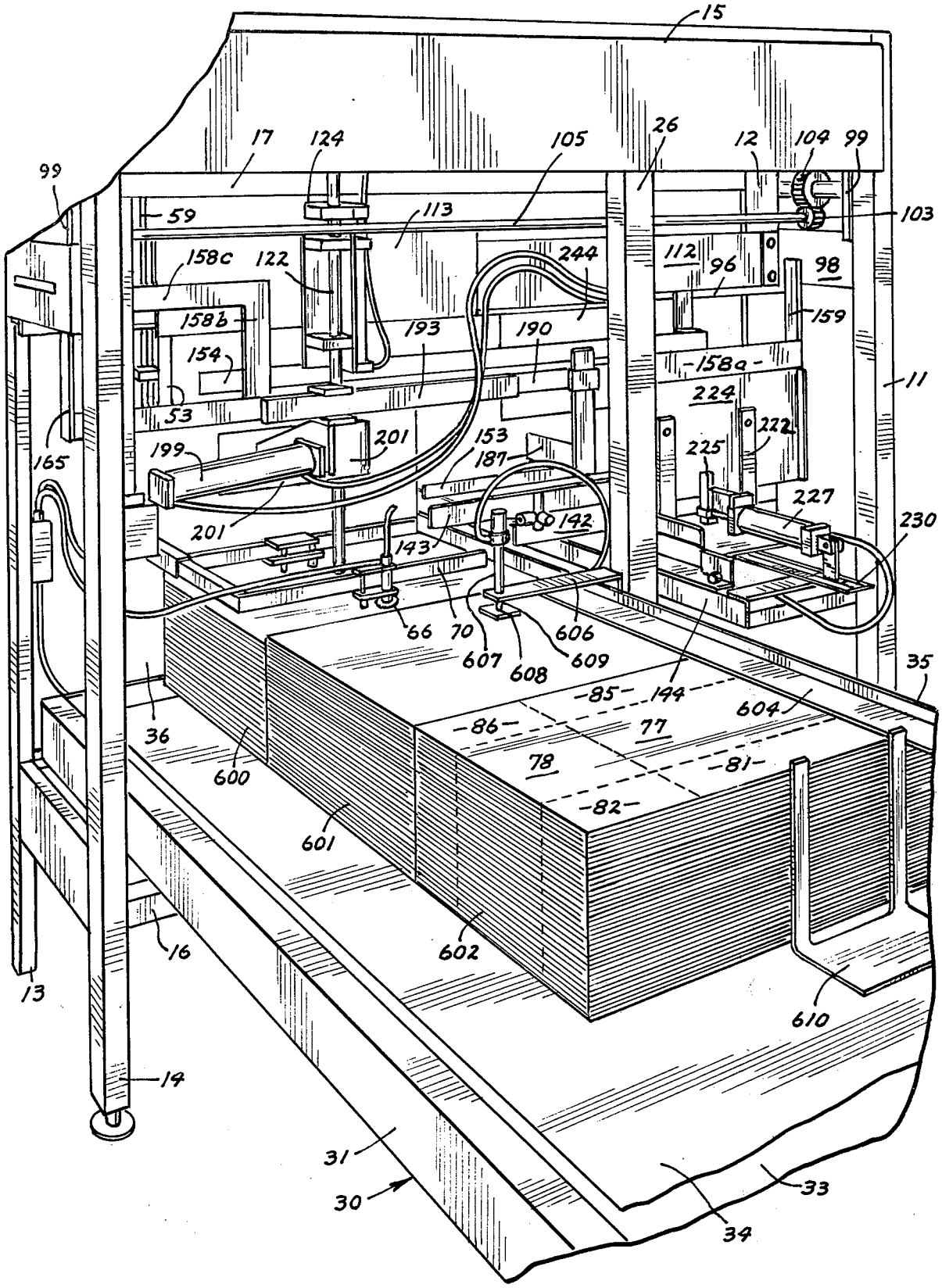
FIG. 2 is a fragmentary perspective view of the magazine end portion of the apparatus of this invention, one of the case erect cylinder assemblies and various other parts not being shown.

Referring now in particular to FIGS. 1-4, the apparatus of the invention includes a frame, generally designated 10. Frame 10 has front uprights 11 and 12, rear uprights 13 and 14, an upper longitudinal channel 15 and a lower longitudinal channel 16 that each have their opposite ends joined to the uprights 11 and 14 respectively, upper and lower longitudinal channels 17 and 18 that each have their opposite ends joined to uprights 12 and 13 respectively, front upper and lower transverse channels 21 and 22 that each have their opposite ends connected to channels 11 and 12 respectively, rear upper and lower transverse channels 23 and 24 that each have their opposite ends connected to uprights 13 and 14 respectively, an intermediate upright 25 that extends between and is joined to longitudinal channels 17 and 18, and an intermediate upright 26 that extends between and is joined to longitudinal channels 15 and 16. For feeding cases in a flat folded condition with cases stacked vertically one above another there is provided a conveyor assembly, generally designated 30, that has transversely elongated U-shaped channels that at their one ends are mounted by a plate 40 which in turn is mounted on channel 18, an intermediate portion mounted by a plate 40 which in turn is mounted on channel 16, and an opposite end portion (not shown). The channel members 31 mount a drive roll 32 (see FIG. 7) that through a suitable drive connection is connected to a motor 410. The drive roll has a horizontal longitudinal axis of rotation and is located above and adjacent channel 18, a belt 34 being extended around the drive roll and an idler roll (not shown) mounted by the end portions of members 31 that are remote from channel 18. Advantageously, the upper run of the belt 34 is supported by a horizontal support plate 33 that extends transversely between the drive roll and the idler roll. A vertical guide plate 35 is mounted by the frame member 31 that is remote from uprights 13 and 14 to extend above and along substantially the entire transverse dimension thereof, while a vertical stop plate 36 is mounted by angle brackets 37 which in turn are mounted to be retained in transversely adjusted positions by brackets 38. The brackets 38 are mounted by a U-shaped channel 39 that extends between and is joined to the one end of the frame members 31. The stop plate is mounted in a position to limit the movement of a stack of case blanks carried by the upper run of the conveyor transversely in the direction of the arrow 41 to be at a proper location to be picked up as will be set forth here next.

Figure 3:
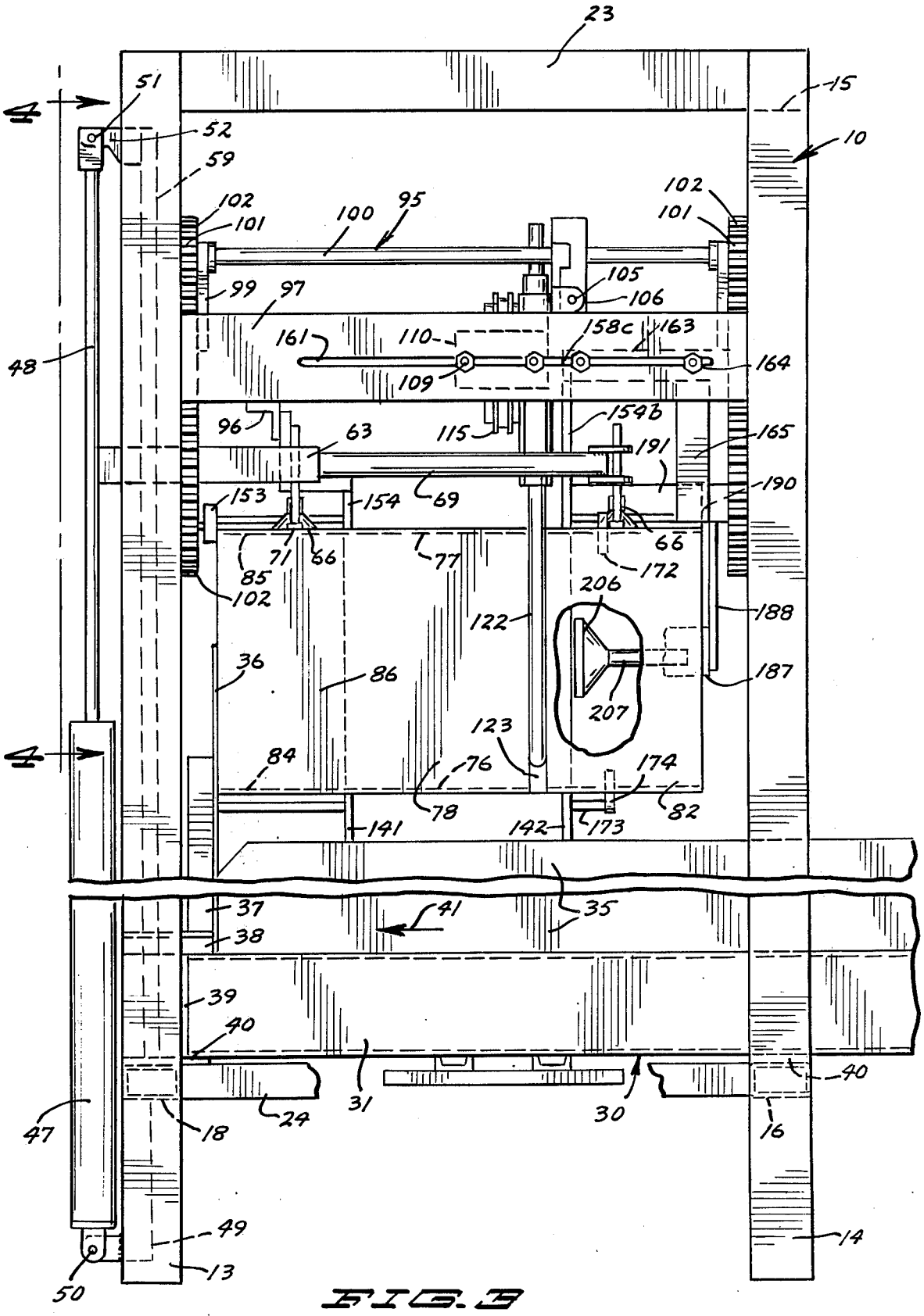
FIG. 3 is a rear view, generally taken along the line and in the direction of the arrows 3—3 of FIG. 1 with portions broken away, said view showing the apparatus in the case erected position.
Figure 2:
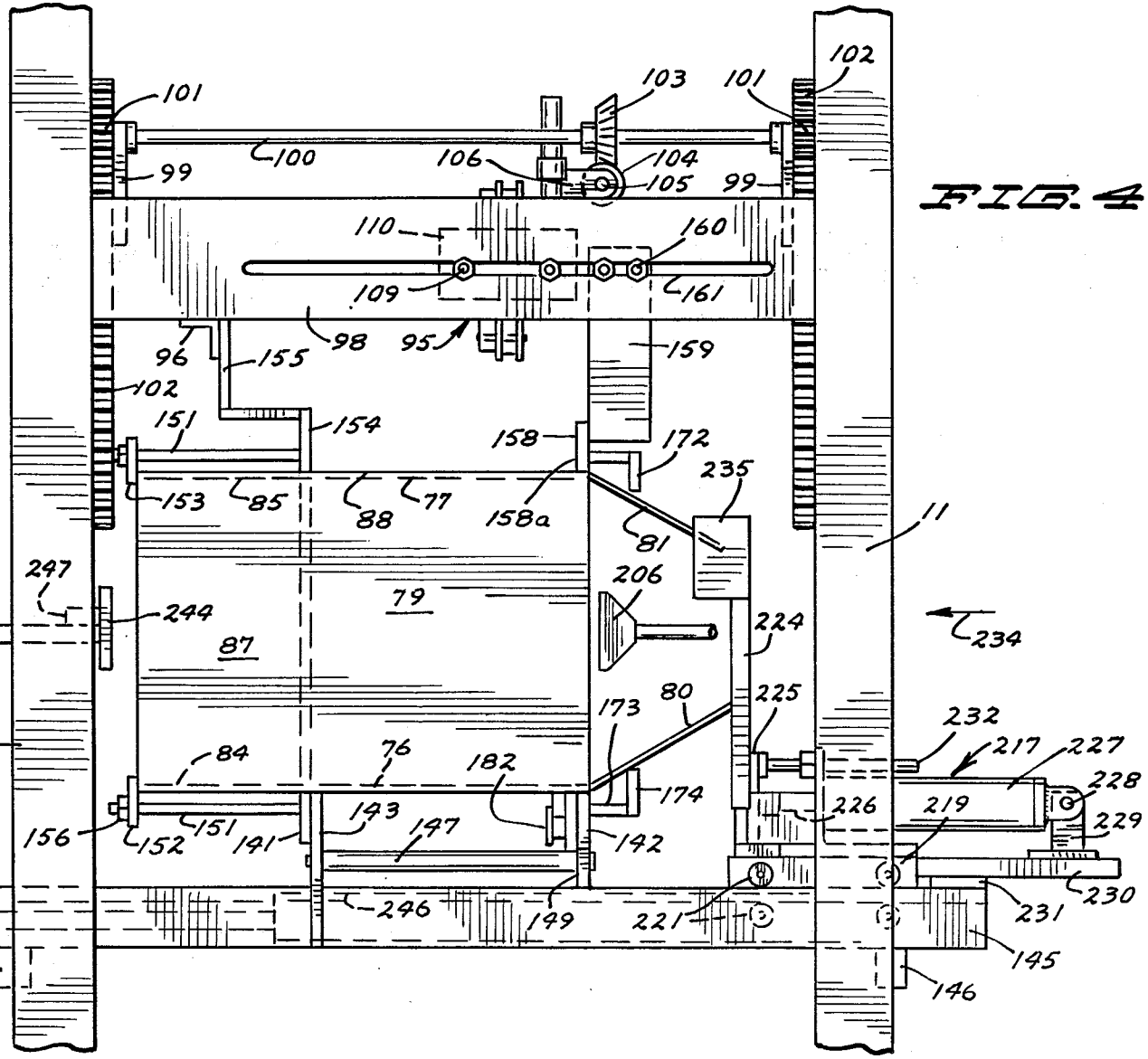
Figures 5, 8:
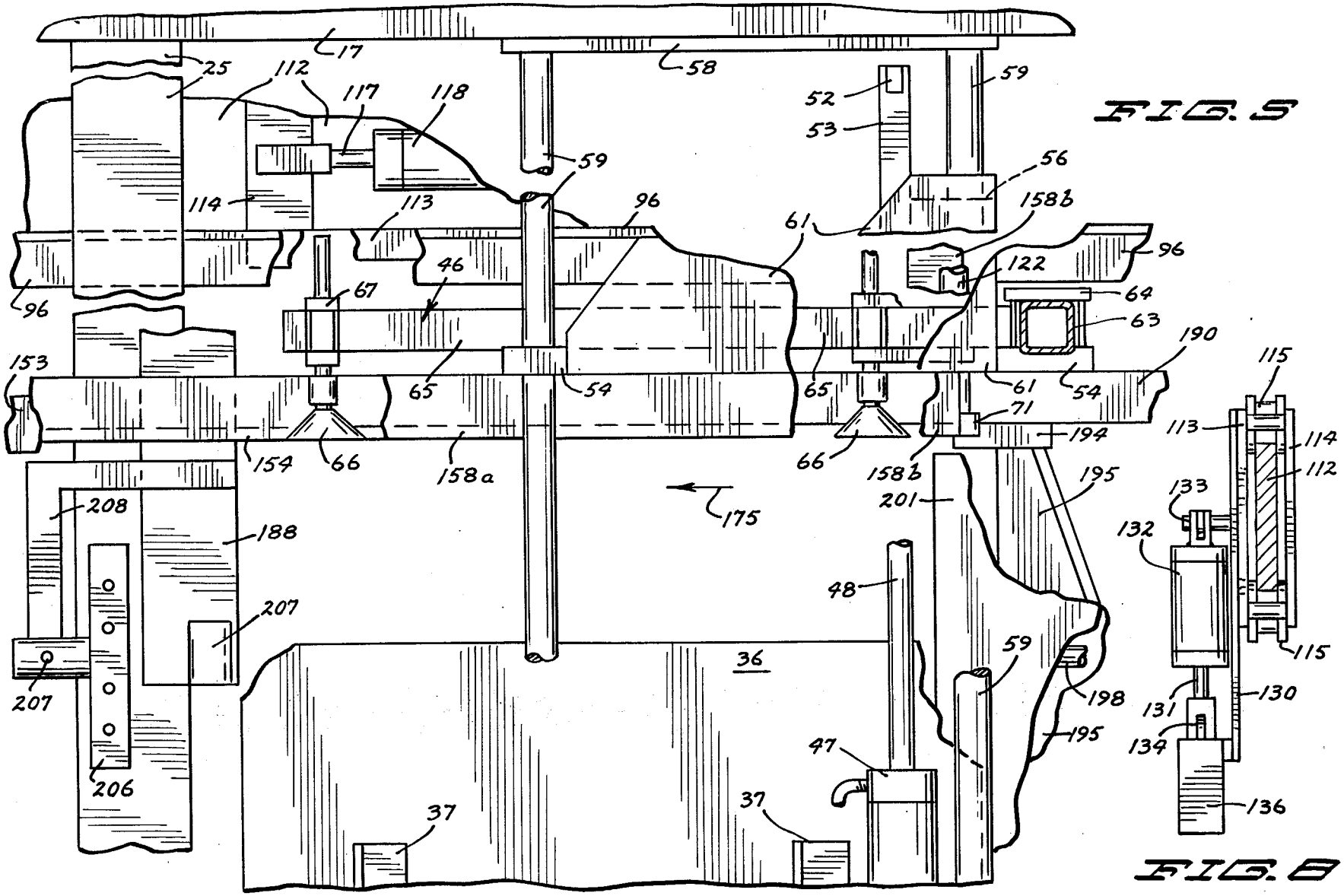
FIG. 5 is a fragmentary side view generally taken along the line and in the direction of the arrows 5—5 of FIG. 3, various portions being broken away to show other parts of the structure.
FIG. 8 is a fragmentary transverse cross-sectional view generally taken along the line and in the direction of the arrows 8—8 of FIG. 6 to more clearly illustrate the erect assembly carriage structure and one of the erecting cylinder assemblies.

For elevating a case blank from a stack of case blanks on the conveyor assembly at a location that the cases abut against the stop plate and the guide plate, there is provided a case lift assembly, generally designated 46, see FIGS. 1, 3 and 5. The lift assembly includes a vertical piston cylinder combination 47,48; the cylinder 48 at one end being pivotally connected at 50 to a bracket 49 that is mounted in depending relationship to the channel 18. The piston rod 48 of the aforementioned combination is pivotally connected at 51 to a bracket 52 which in turn is fixedly attached to the upper clevised end portion of the vertically elongated bar 53. The lower end of bar 53 is welded to a longitudinally extending bar 54 which has its opposite ends mounted for slidable movement on vertical guide rods 59. The upper ends of the guide rods 59 are mounted by a plate 58 which in turn is mounted by channel 17 (FIG. 5) while the lower end of the guide rods are mounted by the plate 40 that is mounted by channel 18. The intermediate portion of the bar 53 also mounts a bar 56 which has an end portion slidably mounted on one of the guide rods while a reinforcing plate 61 is mounted by bars 53,54 and 56.

The rear end of the bar 54 has one end portion of a transversely elongated rectangular channel 63 clamped thereto in a transversely adjusted position by a clamp device 64. The opposite end of channel 63 has the rear end of a longitudinally elongated channel 65 welded thereto. A pair of vacuum cups 66 are mounted on a longitudinally elongated bar 65 by clamp devices 67 and 68 respectively to extend beneath the channel and permit adjusting the longitudinal spacing of the cups. Similarly, a pair of vacuum cups 66 are mounted on a longitudinally elongated cup mounting bar 70, the rear end of which is mounted by one end by a rectangular channel 69. The opposite end portion of channel 69 is slidably extended into channel 63 and is retained in a transversely adjusted position by a conventional mechanism, for example a set screw (not shown).

Each of clamp devices 67 mounts a resilient foot 71 that extends downwardly to substantially the same elevation as cups 66 in a relaxed condition at a location rearwardly of the rear cups 66.

Before further describing the apparatus of this invention, it is to be mentioned that it is to be used for opening and sealing the one ends of case blanks of the type illustrated in FIGS. 10–13. That is, each case blank in the flat folded condition, has major side walls 76,77 and minor side walls 78,79 that are joined at contiguous edges to the major side walls along fold lines. The one ends of the side walls 76 and 77 respectively have the one ends of major flaps 84 and 85 joined thereto to be folded at fold lines while the opposite ends of said side walls have major flaps 80 and 81 joined thereto to be folded along fold lines. The opposite ends of minor side wall 78 has minor flaps 82 and 86 respectively joined thereto along fold lines while the minor side wall 79 has minor flaps 83 and 87 joined thereto to be folded along fold lines. When the cases are in flat folded conditions and a vertical stacked relationship, the walls 77,78 and flaps 81,82,85 and 86 lie substantially in a common plane and are located above wall 76,79 and flaps 80,83,84 and 87 other than where side wall 78 is joined to side wall 76 and side wall 77 is joined to side wall 79. Additionally, the cases are stacked on the conveyor such that the juncture 88 of side walls 77,79 are in abutting relationship to, and in closely adjacent to guide plate 35, while the stacks are conveyed by the conveyor assembly in the direction of the arrow 41 to a position the terminal edges of flaps 84–87 are closely adjacent to or in abutting relationship to the stop plate 36.

The four vacuum cups 66 are mounted on the mounting bars 65,70 such that when the piston rod 48 is retracted, the vacuum cups will abut against the four corner portions of the side wall 77 of the uppermost folded blank in the stack, and with the vacuum being applied to the cups grippingly engage that side wall. Further, feet 71 are located to abut against side wall 78.

The elevated positions of the vacuum cups may be vertically adjusted by adjusting the length of the stroke of piston rod 48, or by using a bracket 52 that is clampable on the piston rod at various selected elevations.

For mounting structure for opening a blank and aid in guiding a blank as the blank is moved forwardly, there is provided a carrier assembly, generally 95 (see FIGS. 1–4). The carrier assembly 95 includes a longitudinally elongated angle iron 96 that at its rear end is fixedly attached to the transverse plate 97 and at the front end to the transverse plate 98. Each end of each of the plates 97,98 is dependently secured to hanger bars 99, the upper edge of the rear hanger bars rotatably mounting the transverse rod 100, and the upper ends of the other pair of bars 99 rotatably mounting a rod 100. Each end of each rod 100 has a pinion 101 keyed thereto to engage the teeth of the adjacent vertically elongated rack 102. Each of the uprights 11–14 mounts a rack 102 so that through the pinions the structure mounted thereby is supported by the racks at the desired elevation, but is vertically adjustable relative the uprights by rotation of rods 100. For selectively rotating the rods 100 in opposite directions, brackets 106 are mounted on plates 97,98 and in turn rotatably mount a longitudinally elongated shaft 105. Each end portion of the shaft 105 has a worm gear 104 keyed thereto to be in driven relationship to a gear 103 that is keyed to the respective shaft 100. The shaft 105 may be driven by a hand crank secured to one end thereof or other suitable mechanism (not shown). By rotating shaft 105 in one direction, plates 97,98 are elevated, and in the opposite direction, are lowered.

An erect carriage assembly, generally designated 111, is mounted for longitudinal movement on a track 112. Each longitudinal end of the track is secured to brackets 110, the brackets at each end being mounted for adjustable transverse movement relative the adjacent one of the mounting plates 97,98 by clamp bolts 109 that are extended through the transversely elongated slot 161 of the respective plate. Thus, by loosening the bolts 109, the bolts may be slid transversely and then tightened to retain the track in the transverse adjusted position.

The carriage includes a longitudinally elongated mounting plate 113 (FIGS. 5, 6 and 7) that extends along one side of the track and bars 114 on the opposite side of the track that are bolted to the adjacent end portion of the mounting plate in fixed spaced relationship thereto. Each bar 114 and the adjacent end portion of the mounting plate rotatably mounts an upper grooved wheel 115 to ride on the upper edge of the track, and a lower grooved wheel 115 to bear against the lower edge of the track. The piston rod 117 of a piston cylinder combination 117,118 has its front end attached to the front plate 114 while the cylinder 118 of the combination has its end opposite the front plate 114 secured to the bracket 110 that is mounted by the carrier plate 97.

A vertical erector assembly mounting plate 120 is transversely adjustably retained along the length of the mounting plate 113 by upper and lower clamp devices 119. Mounted on the erector plate 120 is the cylinder 126 of piston cylinder combination 125,126, the combination including a piston rod 125 mounting a clamp bracket 124 which in turn is clamped to a vertical erector rod 122. The erector rod slidably extends downwardly through a bar 121 that is mounted on plate 120, the lower end of the erector rod mounting a curved plate 123 that extends downwardly and rearwardly thereof.

Also mounted on the mounting plate 113 is a plate 130, plate 130 being at the forward end of the mounting plate. A transverse pivot member 133 attaches the upper end of the cylinder 132 of a piston cylinder combination 131,132 to the mounting plate 130, the piston rod of said combination being pivotally attached at 135 to one end of an arm 134. The midportion of the arm 134 is pivotally connected at 136 to the plate 130 while the front end of said arm dependingly mounts a back-up plate 136.

Figure 6:
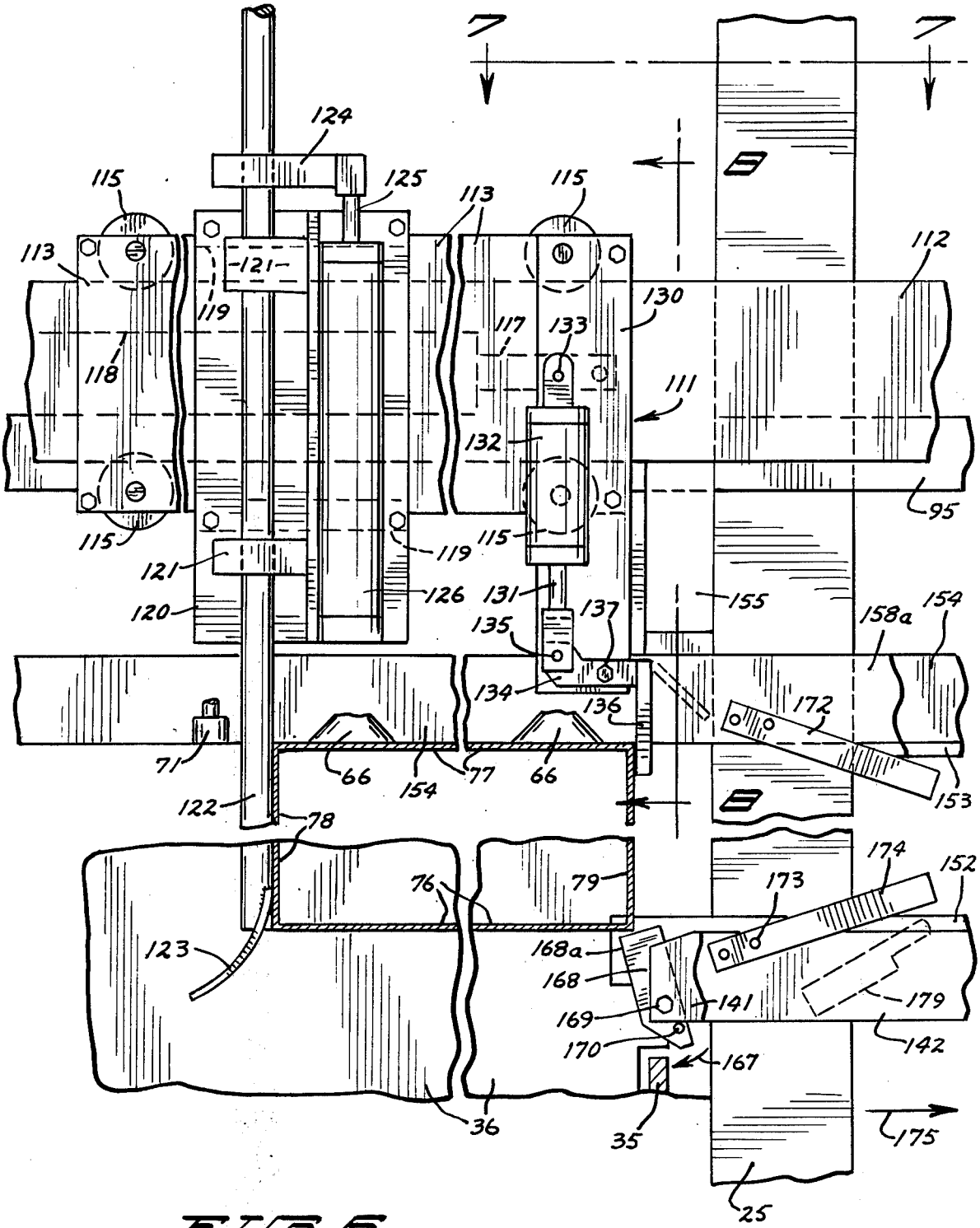
FIG. 6 is a fragmentary longitudinal cross-sectional view taken along the line and in the direction of the arrows 6—6 of FIG. 7 to more clearly illustrate the case erecting assembly, portions being broken away.
Figure 7:
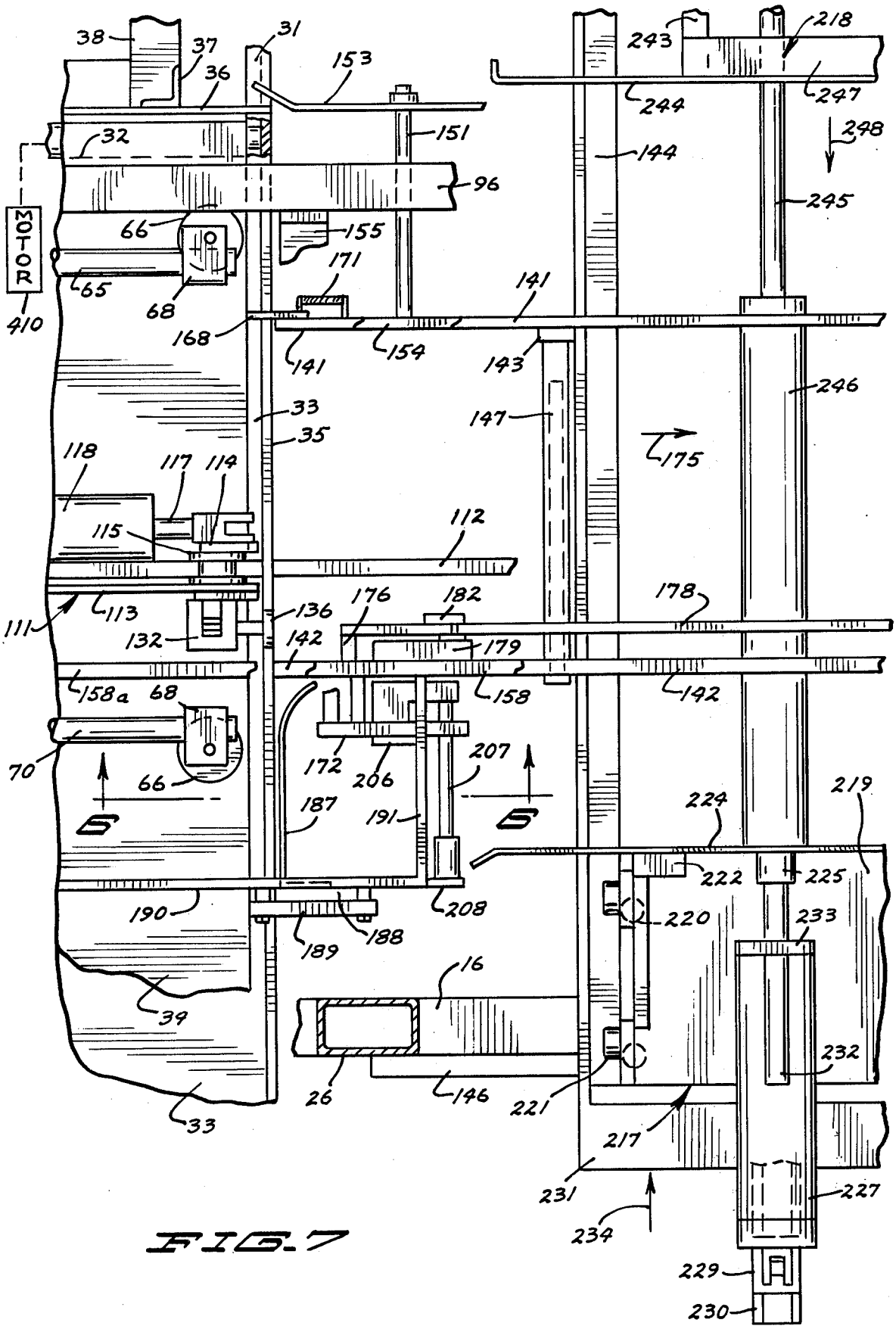

Referring now in particular to FIGS. 4, 6 and 7 there are provided a pair of lower, horizontally elongated slide rails 141,142 which have rear terminal ends vertically above the guide plate 35. Slide rail 141 is mounted by a pair of bars 143, the lower end of each bar being mounted by the adjacent one of the transversely extending tracks 144,145. The tracks 144,145 are mounted by bars 146, one of the bars being mounted by uprights 12 and 25 while the other bar is mounted by the uprights 11 and 26. Each of the bars 143 mounts an interiorly threaded tube and bolt combination 147 which in turn mounts a block 149 that is dependingly attached to the slide rail 142. Combination 147 permits transversely adjustably spacing the rails 141,142 and retains the rail 142 such that its upper edge along at least the major portion of the length thereof is parallel and at substantially the same elevation as the upper edge of rail 141. A pair of transversely elongated rods 151 have their one ends secured to the slide rail 141 on the side opposite slide rail 142 to extend outwardly thereof in parallel relationship. Each of the rods 151 slidably extends through a collar 156 which in turn is welded to the slide rail 152. Lock screws (not shown) are provided for retaining the collars in slidable adjusted positions on the rods 151 to permit changing the transverse spacing of rails 152,141. Similarly, an upper top rail 153 is mounted by a pair of rods 151 to be retained in selected transverse adjusted positions along the lengths thereof while the one ends of rods 151 are secured to an upper slide rail 154 which is mounted vertically above slide rail 141. Other than for inclined front and rear portions of rail 141,152,153 and 154, the lower edge of rail 153 is located at a lower elevation than the lower edge of rail 154 while the upper edge of rail 152 is located at a higher elevation than the upper edge of rail 141. For mounting the slide rail 154 there is provided a pair of angle brackets 155 that each have their horizontal leg attached to the rail and their vertical leg attached to the adjacent portion of the angle iron 96. One of the angle brackets 155 is located adjacent the front end of the slide rail and the other adjacent the rearward end thereof.

Extending parallel to and at substantially the same elevation as slide rail 154, is a slide rail 158. The front end of the slide rail 158 is mounted by the lower end of a bracket 159, the upper end of the bracket mounting a pair of clamp bolts 160 that are slidably extended through a slot 161 of the carrier plate 98 for retaining the bracket in selected transverse adjusted positions on the plate 96. The front end portion **158*a* of the slide rail 158 extends longitudinally linearly from the bracket 159 in a rearward direction to a location a short distance longitudinally forwardly of the transverse cup mounting channel 69, then vertically upwardly along a portion 158*b*, and then horizontally rearwardly along portion 158*c* (also see FIGS. 3 and 5). The rear end portion of portion 158*c* is secured to a transverse plate 163. Plate 163 mounts a pair of clamp bolts 164 that are slidably extended through the slot 161 of carrier plate 97 for clampingly retaining the plate 163 in transverse adjusted positions on the carrier plate. Portion 158*a* is of substantially the same length as slide rail 154, and thus the rear portion of slide rail 154 and the rear portion of slide rail part 158*a* are located in overhanging relationship to the forward part of the conveyor assembly. Additionally, the slide rail part 158*a* and rail 154 extend longitudinally rearwardly of guide plate 35 a distance that is greater than the length L of side wall 77. Rails 141,152,153,154 and 142** are substantially parallel to one another.

To aid in retaining a case in an elevated condition after the vacuum applied to cups 66 has been released and prior to the case being moved onto the slide rails 141,142, the rear end portion of the slide rail 141 mounts a pivot member 169 which in turn mounts a latch 168 (see FIGS. 6 and 7). The latch mounts a stop pin 170 that is abuttable against the lower edge of the rail 141, one end of coil spring 171 being connected to the stop pin and the opposite end of the spring being connected to the rail 141 for resiliently retaining the latch in a position that the pin abuts against the rail. In the last mentioned position, the latch extends primarily vertically and has a rearward edge **168*a* that is inclined rearwardly and predominantly upwardly, and is located rearwardly of the rail. However, the latch can be pivoted against the action of spring in the direction of the arrow 167 to a position that the rearward edge 168*a* is substantially vertically aligned with the rearward surface of guide plate 35. The aforementioned pivotal movement of the latch in the direction of the arrow 167** results from the case blank being elevated by the cups from a position beneath the latch to a higher elevation than the latch.

Substantially transversely spaced from the side of rail 142 that is opposite rail 141 there is provided a folder bar 174 that extends upwardly and forwardly from an elevation that is lower than the adjacent upper edge portion of rail 142 to an elevation that is substantially above the upper edge portion of rail 142. The bar 174 is mounted by pins 173 that are in turn mounted by rail 142. Vertically above the folder bar 174 there is provided a folder bar 172 that is mounted by pins 173 on slide rail portions 158*a*, the rearward end portion of bar 172 being at a higher elevation than the transversely adjacent part of rail portion 158*a* and the front end portion being at a substantially lower elevation. The folder blades 172,174 are positioned for folding major flaps 80,81, from horizontally extending positions to converge toward one another in a direction away from the side wall portions of the case to which they are joined such as illustrated in FIGS. 3 and 12.

For folding flap 83 as a carton is moved in the direction of the arrow 175 onto slide rails 141,142, there is provided a folder blade 187 (see FIG. 7) that is located on the opposite side of rail 142 from rail 141. Blade 187 has an end portion closely adjacent rail 142 that is curved rearwardly and horizontally away from rail 142 and thence extends transversely to a vertical plate 188 by which it is mounted. Plate 188 is retained in a vertically adjusted position on a longitudinally elongated rail 190 by clamp mechanism 189. The forward end of rail 190 is secured to one end of a transverse bar 191, the opposite ends of the bar being welded to rail portion 158*a*. The rearward end of rail 190 is secured to the lower end of a vertical bar 165, the upper end of bar 165 being secured to bar 163 (see FIG. 3).

Rearwardly of the bar 188, spacer blocks 192 are joined to the opposite ends of the slide rail 193 for mounting the rail 193 on the rail 190 (see FIGS. 1 and 5). A flap tucker assembly, generally designated 196, is mounted in selected adjusted longitudinal positions on rails 190, 193 by upper and lower clamp plates 194 that are clamped to said rails, the lower clamp plate mounting a bracket 195. The bracket 195 mounts a cylinder 199 of the piston cylinder combination 198,199 such that the cylinder has its central axis extending forwardly and inwardly toward an open case that is being supported in an elevated position by the vacuum cups. The piston cylinder combination includes a piston rod 198 which slidably extends through bracket 195 and mounts a bracket 200, the bracket 200 in turn mounting a longitudinally elongated folder blade 201 that extends substantially parallel to the slide rails 141,142. The forward end of a guide rod 202 is attached to bracket 200, the guide rod slidably extending through bracket 195 and a block mounted by the cylinder.

For spreading glue on the flaps 82,83 after they are folded to extend inwardly toward one another as shown in FIG. 12, there is provided a glue head device 206 (see FIGS. 3 and 7). The glue device is mounted on a transverse rod 207 which in turn is mounted by an angle bracket 208 such that the device is in part located between the folder blades 172,173. Bracket 208 is mounted on plate 188.

To complete the folding of the flaps 80,81 and to compress the flaps 80–83 to adhere them to one another after glue has been applied to flaps 82,83, there is provided flap folding and compressor mechanism that includes a flap closing carriage assembly, generally designated 218 (see in particular FIGS. 4 and 7). The closing carriage assembly includes a subframe 219 that at the front and rear thereof are mounted wheels 221 to rotate about longitudinal axes and bear against the top and bottom surfaces of the adjacent track 144,145. Further, wheels 220 are mounted on the subframe to rotate about vertical axes to bear against the adjacent vertical edges of tracks 144,145. Brackets 222 are mounted on the subframe to in turn mount the backing plate 224 to extend thereabove and to extend longitudinally except for the rear end portion which is bent to extend rearwardly and transversely away from rail 142.

For moving the carriage subframe 219 between a position that plate 224 is substantially spaced from rail 142 and a position very closely adjacent thereto, there is provided a piston cylinder combination 226,227. The piston rod 226 is secured to a bracket 225 which in turn is mounted on the subframe while the cylinder 227 is pivotally connected at 228 to a bracket 229. Bracket 229 is mounted for transverse, adjustable movement by a track 230 in selected adjusted positions by clamp bolts (not shown), the track being mounted by a longitudinal plate 231 which in turn is mounted by the adjacent ends of tracks 144,145. A guide rod 232 is attached to bracket 225 and slidably extended through a bracket 223 that is secured to the cylinder 227.

A plate 235 is mounted by the front upper edge portion of plate 224 to extend more closely adjacent to the plane of slide rails 141,154 than plate 224.

The carriage assembly 217 is moved transversely in the direction of the arrow 234 when the piston rod moves to its extended position, and in the opposite direction when the piston rod is retracted. The bracket 229 is mounted in a position on the track 230 such that when the piston rod 226 is fully extended the back-up plate moves flaps 80,81 to extend at substantially right anges to the side walls to which they are joined while terminal edges of flaps 84,85 abut against the stop rails 152,153 without causing any significant buckling or folding of flaps 84,85.

The compression carriage assembly 218 includes a carriage subframe 240 that rotatably mounts wheels 220,221 to bear against tracks 144,145 such as was described with reference to assembly 217. Bolts (not shown) are extended through longitudinally elongated grooves in plate 239 and threaded into the subframe for retaining plate 239 in longitudinally adjusted positions on the subframe. Plate 239 mounts an upright 241 which in turn has vertically elongated grooves (not shown) and bolts (not shown) being extended through said grooves and threaded into a bracket 251 (see FIG. 1) that in turn mounts the longitudinally spaced, transversely elongated plates 242 for limited vertical adjustment and retains said plates in selected vertically adjusted positions. Each of the plates 242 mounts the one end portions of transversely elongated bars 243, the opposite ends of which are connected by a bar 247. The bar 247 mounts a press plate 244 that is of a size to be extendable into an open case and to apply pressure against the areas of flaps opposite the glued surfaces thereof to ensure a good glued seal between the flaps at the bottom end of the case.

To move the carriage subframe 240 in the direction of the arrow 248 from the datum position of FIG. 4 to a flap compression position, there is provided a piston cylinder combination 245,246 that includes a piston rod 245 that at one end is pivotally connected to a depending portion of the subframe 240. The cylinder of the aforementioned combination is pivotally connected to a bracket (not shown) which is mounted by the bar 146 that extends between uprights 11 and 26. In their datum positions, the press plate 244 and the back-up plate 224 are located transversely on opposite sides of stop rail 152 and slide rail 141 such as shown in FIG. 4; but in their flap compressed positions, the press plate 244 is located vertically between slide rails 158a and 142 and slightly transversely spaced therefrom so as to compress the flaps against the back-up plate when the back-up plate is substantially vertically aligned with the remote vertical surfaces of slide rail portion 158a and slide rail 142.

Referring to FIG. 9, the control circuit and components, generally designated 260, includes main power lines $L_1$ and $L_2$. A normally closed switch member 264 of the stop switch 259 is connected acrosss line $L_1$ and junction 265 while a start switch 266 that is resiliently retained in an open position is connected across junctions 265,270. Switch member 269 of relay 271 is connected across junctions 265,268, junction 268 being connected by lines to junctions 276 and 270. Connected across junction 270 and main line $L_2$ is the solenoid coil 267 of relay 271 which moves and retains switch member 269 in a closed position when relay 271 is energized.

A normally open case sensing limit switch 277, a normally open glue limit switch 278, a manually operated glue cutoff switch 279 and coil 280 of the glue valve relay 285 are connected in series across junction 276 and main line $L_2$. A normally open switch member 281 of stop switch 259 is connected across main line $L_1$ and junction 282 while the tucker retract solenoid coil 288 of the tucker control valve 287 is connected across junction 282 and main line $L_2$. A case clear of tucker limit switch 283 is connected across main line $L_3$ and junction 282.

A normally open erect cylinder down limit switch 297 and a normally opn switch member 296 of the lift mechanism up limit switch 295 are connected across main line $L_3$ which is connected to junction 276 and junction 292; while a normally open foot switch 292 and a manual-automatic switch 291 are connected in parallel across junction 290,292. The tucker extend solenoid coil 289 of the tucker control valve 287 is connected across junction 290 and main line $L_2$.

A normally open switch member 304 of the stop switch 259 is connected across main line $L_1$ and junction 303 while a normally closed switch member 305 of said stop switch is connected across junction 303 and junction 306. The cylinder "out" solenoid coil 302 of the compression cylinder control valve 301 is connected across main line $L_2$ and junction 303 while the cylinder "in" solenoid coil 307 of said valve is connected across main line $L_2$ and junction 317.

Connected in series across main line $L_3$ and junction 306 is a normally closed switch member 311 of the carriage forward limit switch 310 and a normally open switch member 309 of the carriage forward limit switch 295. The erect cylinder "down" solenoid coil 312 of the erect cylinder control valve 313 is connected across main line $L_2$ and junction 306. A normally open switch member 316 of limit switch 310 is connected across main line $L_3$ and junction 317 while erect cylinder "up" solenoid coil 318 is connected across said junction and main line $L_2$. A normally closed switch member 319 of limit switch 295 and the carriage "back" solenoid coil 320 of the carriage control valve 321 are connected in series across junction 317 and main line $L_2$.

A switch member 326 of the tucker retracted limit switch 328, a normally closed compression cylinder "back" limit switch 327, and the carriage forward solenoid coil 322 of the carriage control valve 321 are connected in series across main line $L_2$,$L_3$. Limit switch 328 also includes a switch member 329 that is connected across line $L_3$ and junction 330, switch member 329 being in an open condition and 326 in a closed condition when the tucker plate piston rod is extended, and switch member 326 being open and switch member 329 being closed when the tucker piston rod is retracted. A case "in" limit switch 331 is connected across junction 330,332 while a normally open switch member 333 of the carriage forward limit switch and a normally open case clear limit switch 335 are connected in parallel across junctions 332,334. The lift mechanism "down" solenoid coil 339 of the lift mechanism control valve 340 is connected across junction 334 and main line $L_2$. A lift mechanism "up" solenoid coil 341 of valve 340 and a normally open carriage back limit switch 342 are connected in series across main lines $L_2$,$L_3$. The solenoid coil 345 of vacuum control valve 344 is connected across junction 330 and main line $L_2$.

A vacuum source 350 is connected by a line 351 to a first port 352 of valve 344, the valve including a port 353 that is connected by a line 356 to lines 357, an exhaust port and a valve member 355. When the solenoid coil 345 is deenergized, valve member 355 connects port 353 to the exhaust port, and when the coil is energized, it connects port 353 to port 352 whereby a vacuum is applied through lines 356,357 to cups 66.

A first port of valve 340 is connected by a line 361 to line 371, line 371 in turn being connected to a source of pressurized air 370. A second port of valve 340 is fluidly connected by a line 362 to the lower end of the lift mechanism cylinder 47 while the upper end of said cylinder is fluidly connected through a line 363 to a third port of valve 340. The valve also includes a fourth port which is an exhaust port, and a valve member 364.

The carriage control valve 321 has a first port that is connected by a line 366 to pressure line 371, a second port that is connected by a line 367 to the rear end of cylinder 118, a third port that is connected by a line 368 to the forward end of cylinder 118, a fourth port that is an exhaust port, and a valve member 369. The erect cylinder control valve 313 includes a first port that is connected by a line 372 to pressure line 371, a second port that is connected by a line 373 to the upper ends of cylinders 126,132, a third port that is connected by a line 374 to the lower ends of cylinder 126,132, a fourth port that is an exhaust port, and a valve member 375.

The compression cylinder control valve 301 includes a first port that is connected by a line 378 to the pressure line 371, a second port that is connected by line 380 for applying fluid under pressure to the end of cylinder 227 for retracting piston rod 226 and the end of cylinder 246 for extending piston rod 245; a third port that is connected by a line 380 to the other ends of cylinders 227,246; a fourth port that is an exhaust port, and a valve member 381.

The tucker cylinder control valve 287 includes a first port that is connected by a line 384 to the pressure line 371, a second port that is connected by a line 386 to one end of the tucker cylinder 199, a third port that is connected by a line 385 to the opposite end of the tucker cylinder, a fourth port that is an exhaust port, and a valve member 387. Each of valves 287,301,313,321 and 340 is of a type that when one of the respective solenoid coils has been energized, the valve member of the respective valve is moved to apply fluid under pressure to the one end of the cylinder to which the valve is fluidly connected and exhaust the opposite end; and when the second solenoid coil of the respective valve is energized, the respective valve member is moved to apply fluid under pressure to the other end of the respective cylinder and exhaust the one end. At the time that neither of the solenoid coils of the respective valve is energized, the valve member remains in the last position that it was moved to through the energization of one of the solenoid coils of the valve to maintain the fluid connections that were made at the time the last solenoid coil of the valve was energized.

The glue control valve 285 includes a first port 391 that is connected by a line 390 to the pressure line 371, a second port 392 that is connected by a line 389 to apply fluid under pressure to the glue device 206, an exhaust port, and a valve member 393. When the coil 280 is deenergized, the valve member 393 fluidly connects port 392 to the exhaust, and when the coil is energized, the valve member fluidly connects port 392 to port 391.

Assuming that no case blanks are on the belt conveyor assembly, first a series of transversely spaced stacks of flat folded case blanks are positioned on the upper run of belt 34 with their edges 88 that are formed by the junctures of major and minor side walls 77,79 abutting against the guide plate 35, and the edges of flaps 84,85,86 and 87 that extend transverse to edge 88 facing toward the stop plate 36. Further, switch 279 is moved to its "on" position. Now the start switch 266 is depressed to energize coil 267 which in turn moves its relay 269 to a hold-in position to maintain the coil energized even though the switch member 266 resiliently moves to an open position. This results in power being applied across main lines $L_2$,$L_3$. The case sensing switch includes a switch member (not shown) that is closed at the time the sensor member 29 is not abutting against the stack of cases on the belt, the last mentioned switch member and the belt motor 410 for driving belt 34 being in series across main line $L_3$ and $L_2$. As a result the belt motor is energized to move the conveyor belt upper run in the direction toward the sensor member 29. At the time the first stack of blanks is moved to abut against the stop plate 36, the sensor rod 29 is moved by the first stack to open the switch member (not shown) of the sensing switch to deenergize the belt drive motor and to move switch member 331 of the sensing switch to a closed position until such time that there are no case blanks of the first stack on belt 34 to retain the sensor rod in its drive motor deenergizing position. At that time sensor rod 29 is resiliently urged to a position to operate switch member 331 to an open position and the switch member (not shown) to a closed position to energize the belt drive motor.

To be mentioned is that in addition to the first stack of blanks 600 on the conveyor assembly, additional stacks 601 and 602 et cetera are positioned on the conveyor assembly with the stack 601 more remote from the stop plate 36 than stack 600. Advantageously a horizontal top plate 604 is mounted on the guide plate 35 to have its bottom surface at the maximum elevation of the uppermost blank of a stack of blanks that can be properly picked up by the vacuum cup assembly. Plate 604 extends only in partial overhanging relationship to stacks 601 and 602 and has the longitudinal edge that is closest to plate 36 terminating at a location that the plate does not overhang any part of stack 600 when the plate abuts against the stop plate 36. By providing plate 604, the operator can readily see when he has placed the maximum number of case blanks in a stack on the conveyor.

Even though for many different sizes of case blanks the stacks may be transversely spaced from one another, for some case blanks, especially small size blanks, it is advantageous to have the stacks in edge to edge abutting relationship so that the stack secondmost closely adjacent the stop plate will aid in retaining the stack abutting against the stop plate in a vertical condition (i.e. the blanks in the stack vertically aligned).

A bracket 606 mounts a cylinder 607 in a position to be vertically above the transverse central portion of the stack of blanks that abuts against the stack of blanks which in turn abuts against the stop plate 36. The piston rod 608 of the piston cylinder combination 607,608 mounts a horizontal plate 609 to abut against said second stack when air under pressure is applied to the upper end of the cylinder, and to move the plate vertically upwardly when air under pressure is applied to the lower end of the cylinder. For controlling the application of air under pressure to cylinder 607, advantageously a conventional solenoid operated air valve (not shown) has its solenoid coil connected in series with a switch member (not shown) of the case sensing switch whereby when the sensor member 29 is in a position to energize the conveyor belt motor, air under pressure is applied to the lower end of cylinder 607; and when the member 29 is in a belt motor deenergize position, air under pressure is applied to the upper end of the cylinder. With plate 609 in its lowered position its abuts against the second stack to hold down the blanks thereon and the blanks of the second stack being in edge to edge abutting relationship with those in the first stack, act to hold the next topmost blank of the first stack down as the top blank is vertically elevated from the first stack. Advantageously, a bracket 610 having a leg extending vertically is provided to be positioned on the conveyor belt to abut against the terminal edges of the blanks of the stack furtherest remote from the stop plate for vertically aligning said edges and aid in retaining the stacks of blanks in edge to edge abutting relationship.

For purposes of further describing the invention, it will be assumed that switch member 331 is in a closed condition, that the erecting rod carriage is being retracted to its rearward position, that the vacuum is being applied to the cups 66, and that the lift assembly is in its down position such that the cups grippingly engage the uppermost folded case blank on the first stack. In this connection it is to be mentnioned that the cups are adjustably spaced on the lift mechanism so that one cup is located adjacent each of the corners of the major flap 77. When the erecting rod carriage has been fully retracted, an operator thereon (not shown) operates limit switch 342 to a closed condition to energize the lift assembly "up" coil 341 whereby valve member 364 is moved to apply fluid under pressure through line 362 to the lower end of cylinder 47. As a result the cups are moved vertically upwardly with the uppermost blank on the stack in a flat folded condition. As the blank is moved upwardly, the blank edge 88 engages the hold-up bar 168 to pivot it in the direction of the arrow 167 to permit the blank to be moved thereabove and thereafter the bar 168 is spring returned to its datum position as illustrated in FIG. 6.

Upon the lift assembly being moved to its uppermost position an operator thereon (not shown) operates the lift mechanism limit switch 295 to close switch members 296 and 309 and open switch member 319. The opening of switch member 319 deenergizes the carriage retract solenoid coil 320 (if energized). The closing of switch member 309 energizes the compression cylinder "out" solenoid coil 302 whereby fluid under pressure is applied through line 380 to the ends of the cylinders 227,246 such that piston rod 226 is retracted and the piston rod 245 is extended. This results in compression assembly carriages 217 and 218 moving transversely apart and thereby press plate 244 and flap folding plate 224 moving to their transversely spread apart datum positions. At the time the plates 244,224 are out of the datum positions, the compression cylinder limit switch 327 is open, but is closed upon said plates returning to their datum positions (for example, by carriage 217 abutting against the limit switch).

The closing of switch member 309 also energizes the erect cylinder "down" solenoid coil 312 which results in valve member 375 moving to a position to apply air under pressure through line 373 to the upper ends of cylinders 126,132, and to exhaust the lower ends of said cylinders. This results in the piston rod 131 moving downwardly whereupon plate 136 is moved from the dotted line position of FIG. 5 to the solid line position thereof. Further, piston rod 125 moves downwardly to lower the erecting rod and folder plate 123. The plate 123 in being lowered abuts against the minor side wall 78 to pivot it about its juncture with side wall 77 which in turn moves major side wall 76 downwardly and forwardly, and therethrough side wall 79 to a vertical condition such as shown in FIG. 6. Side wall 79 in being moved to a vertical condition abuts against plate 136 which in conjunction with rod 122 aids in retaining side walls 78,79 in parallel vertical extending relationship. Further, at this time the edge formed by the junctures of side walls 76,79 abuts against the upper edge of plate 168 to be supported thereby. Additionally, the movement of the side wall 78,79 in the aforementioned manner, results in flaps 82,86 being moved to extend vertically and parallel to flaps 83,87 which are moved to extend vertically. Upon the erect rod 122 moving to its lowered position, block 124 abuts against erect cylinder limit switch 297 to operate said switch to a closed position. In this connection it is to be mentioned that the limit switch 297 is mounted on the frame in a position to be closed when the erect carriage is in its retracted position, but will resiliently move to an open position upon the erect carriage being moved forward of its retracted position. Upon the erect cylinder limit switch 297 closing and with switch 291 previously being manually moved to stay in a closed position, the tucker cylinder extend solenoid coil 289 is energized. The resulting movement of valve member 387 applies fluid under pressure to cylinder 199 such that piston rod 198 is extended and thereby the tucker folder plate 201 moved forwardly and transversely toward flap 82 to be located more closely adjacent the side walls of the erected blank. The height of the tucker folder plate is somewhat less than the height of the flaps 82,83, and is located at an elevation vertically between the horizontally extending flaps 80,81. As the folder blade is moved to its extended position, it engages flap 82 to pivot flap 82 in the direction of the arrow 396 (FIG. 12) to a position to extend at generally right angles to side wall 78. The folder blade in being moved to its extended position underlies flap 81 and as a result, aids in supporting the erected blank at the time the application of a vacuum to the cups 66 is terminated. The tucker blade in being moved closely adjacent to an extended position (after extending between flaps 80,81) moves its guide rod whereby the tucker limit switch 328 is operated to close switch member 326 and open switch member 329. The opening of switch member 329 deenergizes the vacuum control valve to discontinue the application of vacuum through the cups whereby the gripping engagement of the cups with side wall 77 is released. Upon switch member 326 closing, provided that switch member 327 is closed, and if not, upon the closing of switch member 327, the erect and carriage forward solenoid coil 322 is energized. This results in valve member 369 moving to apply fluid under pressure through line 367 to the back end of cylinder 118 whereupon the carriage plate 133 and the structure mounted thereon is moved forwardly. The forward movement of the erect rod carriage moves the erect rod 122 in the same direction whereby it pushes the erected case blank into overhanging relationship with slide rails 141,142 such that the side wall 76 bears thereagainst, the junctures of flaps 80–83 to the side walls above slide rail 142 or to the right thereof as viewed in FIG. 4, and the terminal edges of 85,86 that are remote from the side walls abut against elongated longitudinal portions of stop rails 153,152. As shown in FIG. 7, rail 153, and also rail 152 has terminal rear end portions that extend rearwardly and transversely away from rails 154,151. During the initial forward movement of the erect rod carriage the erect cylinder limit switch 297 moves to an open condition to deenergize the tucker extend solenoid 289.

As the carriage is moved forwardly, flaps 80,81 are moved into abutting relationship to the folder bars 174,172 respectively; and since the bars converge in a forward direction, flaps 80,81 are folded toward one another such that flap 80 extends upwardly and transversely outwardly at an angle, for example, about 30 degrees to the horizontal, and flap 81 extends transversely outwardly and downwardly at an angle, for example, about 30 degrees to the horizontal, such as illustrated in FIG. 3. That is, the folder bars fold the flaps 80,81 to extend outwardly from the side walls to which they are attached at substantially equal, but opposite angles. This folding of flaps 80,81 retains flaps 82,83 in their folded condition.

During the initial forward movement of the erect rod carriage, it moves out of engagement with limit switch 342 whereby switch member 342 moves to an open condition to deenergize the lift mechanism "up" solenoid coil 341. Prior to the erector rod moving the erected blank sufficiently forward to start the folding of the major flaps 80,81, flap 83 is moved into abutting engagement with the folder blade 187. As the erected blank is moved forwardly, the folder blade 187 pivots flap 83 about its junctures to side wall 79 to extend at right angles to said side wall and toward the folded flap 82 before any substantial folding of flaps 80,81 by the folder bars 174, 172 occurs.

It is to be mentioned that the tucker blade is moved to its extended position prior to the blank being moved sufficiently forwardly that the folding of flaps 80,81 by bars 174,172 starts to occur.

After the erected blank being moved sufficiently forwardly to clear the tucker blade in its extended position, the erecting rod carriage has moved sufficiently forwardly to have an operator thereon (not shown) operate switch 283 to a closed condition whereby the tucker retract solenoid coil 288 is energized. This moves valve member 287 to apply pressurized fluid through line 385 to cylinder 199 for retracting the tucker blade. As the tucker blade is retracted, the guide rod 202 operates the tucker retract limit switch 328 to open switch member 326 for deenergizing the erecting rod carriage forward solenoid coil 322, and to close switch member 329 for energizing the vacuum control valve 344. The energizing of valve 344 results in the application of a vacuum to the vacuum cups 66.

After the erecting rod carriage has moved the erected case sufficiently forwardly along the slide rails that the case is entirely longitudinally forwardly of the lift mechanism rods 65,70 an operator on the carriage closes the case clear lift limit switch 335 whereby the lift mechanism down solenoid coil 339 is energized. As a result, air under pressure is applied through line 363 to the upper end of the lift cylinder 47 to lower the vacuum cups 66 to a position to engage the upper surface of the then uppermost folded carton in the stack on the conveyor assembly that abuts sensor rod 29. As the lift mechanism is operated to its lower position, it moves out of engagement with the lift mechanism up limit switch 295 which results in the closing of switch member 319, the opening of switch member 296, and the opening of switch member 309. As a result of switch member 309 opening, the erect cylinder down solenoid coil 312 is deenergized, and the compression cylinder out solenoid coil 302 is deenergized.

As the case is moved forwardly along the slide rails it engages the case sensing limit switch 277 and retains the switch in a closed position as long as it is in engagement therewith. After switch member 277 has been closed, a cam (not shown) on the erecting rod carriage has a first tab thereon that engages limit switch 278 to close said limit switch and thereby energize the glue valve solenoid coil to apply fluid under pressure to the glue device 206 for spraying glue on the folded flap 83. The first tab moves out of engagement with the limit switch 278 to discontinue the spraying of glue prior to flap 83 having moved past the glue device. Thence a second tab of the cam moves into engagement with limit switch 278 and engages the limit switch a sufficient period of time to spray glue on the folded flap 82 and discontinue the application of glue prior to the time the flap is moved completely past the glue device. As a result, glue is only sprayed on flaps 82,83. After the case has been moved past the gluing device, the case moves out of engagement with limit switch 277, and as a result said limit switch opens to prevent energization of the glue valve until another case has been moved to be transversely adjacent to the glue device.

By the time the case has been moved sufficiently forwardly that flap 82 is transversely adjacent the glue device, the case has been moved to be entirely longitudinally forwardly of the tucker folder blade 201. At this time an operator (not shown) on the erecting rod carriage moves out of engagement with limit switch 283 whereby the tucker retract solenoid coil 288 is deenergized; and the operator for the case clear limit switch 335 is moved out of engagement with the limit switch to deenergize the lift mechanism down solenoid coil 339. Thereafter, the erect carriage moves to its forwardmost position whereat the operator (not shown) on the carriage operates the carriage forward limit switch 310 to close switch member 316. The closing of switch member 316 completes the circuit for energizing the erect cylinder "up" solenoid coil 318 whereby fluid under pressure is applied through line 374 to the lower end of the erect rod cylinder 126 to elevate the erecting rod, and to the lower end of cylinder 132 whereby plate 136 is pivoted to the dotted position of FIG. 5 so that the entire plate is at a higher elevation than the top of the case on the slide rails.

As the case is moved forwardly along the slide rails it moves into abutting engagement with the latch 179 to pivot it in the direction of the arrow 398 about pivot 180 to a position that it does not extend to a higher elevation than the slide rail 142 (see FIG. 14). Thence the case is moved across the latch 179 and upon the side wall 78 being moved just forwardly of the front generally vertical edge of the latch, the latch under the weight of gravity pivots in the direction opposite arrow 398 to the solid line position of FIG. 14 whereby it acts as a stop to prevent the erect case blank being moved rearwardly. Further, at this time flap 81 moves into abutting engagement with stop plate 235. The stop plate 235 and latch 179 act to hold the case blank in an erect condition on the slide rails at the time plate 136 and the erecting rod are moved out of engagement with side walls 78,79 respectively.

The closing of switch member 316 also results in the carriage back solenoid coil 320 being energized whereby fluid under pressure is applied through line 368 to the forward end of cylinder 118, there being a sufficient delay in cylinder 118 moving its piston rod 117 rearwardly that the plate 136 is first moved above the elevation of the case. The retraction of piston rod 117 results in the erecting rod carriage and structure thereon being retracted. Additionally, the closing of switch member 316 results in the compression cylinder "in" solenoid coil 307 being energized whereby fluid under pressure is applied through line 379 to cylinder 227 to move the carriage 217 and the backing plate 224 that is mounted thereon from its datum position in the direction toward the press plate 244. Due to the backing plate 224 in its datum position abutting against the terminal edges of flaps 80, 81 that are parallel to the direction of movement of the case, as the flaps 80,81 move out of engagement with the folder bars 172,174, the backing plate in its datum position holds said flaps to converge toward one another such as shown in FIG. 4. At this time flaps 85,84 abut against stop rails 153, 152 respectively, and accordingly as the backing plate is moved from its datum position, it applies a force through the terminal edges of flaps 80,81 to fold the flaps 80,81 toward one another. This folding of flaps 81, 80 bring the terminal transverse edges thereof more closely adjacent forward flaps 82,83 whereby flaps 81, 80 are moved to abut against the surfaces of flaps 82,83 that have glue thereon. Further, since plate 224 abuts against the above mentioned terminal edges of flaps 80, 81 as plate 224 moves transversely it simultaneously fold flaps 80,81 through substantially equal angular increments throughout the longitudinal length thereof. As a result, if flaps 80,81 are of sufficient transverse lengths, the terminal edges thereof will abut against one another in the flap completely folded condition (not overlap or partially overlap). If these edges abut prior to the folding being completed, the abutting edges will result in the flaps 80, 81 being pushed away from one another to prevent overlapping of portions of the major flaps. This provides a square case bottom. If flaps 80,81 are not of sufficient transverse lengths then the terminal edges of flaps 80,81 in a flap completely folded condition will be spaced and parallel to one another.

At the same time the backing plate 224 is being moved from its datum position, the application of fluid under pressure to cylinder 246 results in carriage 218 and the press plate 244 that is mounted thereon being moved in the direction of the arrow 248. The plate 244 is moved into the folded carton to abut against the surfaces of flaps 82,83 for pressing said flaps against flaps 81,80 and the last mentioned flaps in turn against plate 224 for promoting good adhesion between the flaps. At the time the compression carriages 217,218 are being moved toward one another, one of these carriages moves out of engagement with limit switch 327 whereby the limit switch resiliently moves to an open position to preclude the carriage forward solenoid coil 322 being energized until the carriage 217,218 and thereby the backing plate and press plate have been returned to their datum positions.

At the time switch member 316 closes, switch member 333 is also closed whereby the lift mechanism down solenoid coil 339 is energized to move valve member 364 to apply fluid to the upper end 363 of cylinder 473, provided the valve member 364 has not previously been moved to this position during the time the erecting rod carriage was moving forwardly. At the time switch member 333 is closed, switch member 311 opens to prevent the compression cylinder out solenoid coil 302 and the erect cylinder down solenoid coil 312 being energized as long as the erect carriage is in its forwardmost position.

Through fluid under pressure being applied to the front end of the carriage retract cylinder 118, the erecting rod carriage starts to move back and as a result the operator on the carriage moves out of engagement with the limit switch 310. This results in switch member 333 opening to deenergize the lift down solenoid coil 339, switch member 311 closing, and switch member 316 opening. Upon the opening of switch member 316, the erect cylinder up solenoid coil 318 is deenergized, the carriage back solenoid coil 320 is deenergized, and the compression cylinder out solenoid coil 307 is deenergized. Upon the erecting rod carriage being retracted to its rearwardmost position, the operator thereon engages the limit switch 342 to close the limit switch and start another cycle of operation such as has been set forth.

When a second case is moved forwardly, it will move the previously sealed and compressed case off the slide rails 141,142 onto a suitable machine for carrying out further operations, or the first case may be manually removed. In connection therewith it is to be noted that the vertical edge of the stop plate 235 of the assembly 217 in the datum position is sufficiently transversely spaced from slide rail 142 that the sealed case may be moved longitudinally forwardly without abutting against plate 235.

As has been previously indicated, when no flat folded cases are closely adjacent stop plate 36, the sensing rod 29 is resiliently returned to a position that opens switch member 331 of the case sensing switch, and accordingly the lift mechanism down solenoid coil 339 cannot be energized until switch member 331 is closed. Thus, the lift mechanism including vacuum cups 66 is in an elevated condition until a new stack of blanks has been transversely moved to move the sensing rod 29 to close switch member 331.

The stop switch is resiliently retained with its switch members in the positions indicated in FIG. 9. However, upon manually depressing the switch member 264, switch members 264 and 305 are moved to open conditions and switch members 281,304 to closed positions. The opening of switch member 264 deenergizes relay 271 to discontinue the application of power to line $L_3$; the closing of switch member 281 energizes coil 288, if not energized, to retract the tucker blade 201; the closing of switch member 304 energizes the compression out solenoid coil 302 whereby the compression plate and backing plate are moved to their datum positions, if out of said positions, and the opening of switch member 305 deenergizes or prevents erect cylinder down solenoid coil 312 being energized at the time switch member 304 closes.

Even though a pair of side walls and flaps joined thereto have been referred to as minor side walls and flaps, it is to be understood that it is within the purview of this invention that the flaps and side walls referred to as "minor" may be of the same size as, or larger than the flaps and side walls referred to as "major."

For many cases the latch mechanism 176–182, the erecting cylinder assembly 131–136, and stop plate 235 can be eliminated provided a longitudinally elongated row brush (not shown) is mounted on rail 142 to have the bristles thereof extend vertically upwardly a short distance above the rail to abut against the lower side wall of the case from the time prior to the case being moved longitudinally to a position to have the backing plate complete the folding of flaps 80,81. Further, the brush is of a length that even with the case in a position that the backing plate is moved to complete the folding of the flaps, the brush bristles abut against a substantial longitudinal length portion of the case side wall 76. The brush bristles act to retard the movement of side wall 76 forwardly and resiliently elevate the case so that side wall 77 abuts against rails 154,158 while rod 122 in abutting against wall 78 retains wall 78 vertical. This results in the case being in a rectangular condition at the time the backing plate moves to complete the folding of the flaps.

What is claimed is:

1. In a machine for erecting and folding a flat folded case blank having a pair of rectangular minor side walls joined at fold lines to opposed edges of a pair of rectangular major side walls, a longitudinally elongated frame having a rear end portion and a front end portion, support means for aidingly supporting a case blank after it is opened and supporting the opened case blank as the opened case blank is moved from a location remotely rearwardly of the frame front end portion to the frame front end portion, first means at the frame rear end portion for supporting a stack of said flat folded blanks in vertical stacked relationship with each blank having an upper major and a minor side wall above a lower major and a minor side wall, second means on the frame for gripping the upper major side wall of a blank on the top of the stack and moving the gripped case blank away from the stack to a position for the gripped blank in an opened condition being moved onto and along the means for supporting an opened case blank and thence release the gripped case blank, and third means for abutting against the upper minor side wall of the gripped blank to fold the upper minor side wall to extend at about right angles to the upper major side wall to open the gripped case blank and after the gripped case blank is released by the second means, move the opened case blank along the means for supporting a case blank in an opened condition, and fourth means for mounting the abutting means on the frame and moving the abutting means from the frame rear end portion toward the frame front end portion to move the opened case toward the frame front end portion.

2. The apparatus of claim 1 wherein each folded case blank has upper and lower major and minor flaps joined along fold lines to the upper and lower major and minor side walls respectively, further characterized in that the gripping means includes operable gripper members for releasably gripping the upper major side wall, and means for moving the gripper members between a first position for grippingly engaging a blank on the stack and a second position at a higher elevation than the stack, and that the fourth means includes means mounted on the frame for moving the abutting means to open the gripped blank whereby the major side walls and flaps extend at about right angles to the minor side walls and flaps when the gripper members are grippingly engaging the case blank in the gripper members second position.

3. The apparatus of claim 2 further characterized in that there is provided a folder member and operable means mounted on the frame for moving the folder member between a retracted first position and an extended second position to fold the adjacent minor flap to extend about at right angles to the minor side wall to which it is joined and toward the other minor flap, and between the major flaps, and means for operating the folder member operable means to move the folder member to its extended position while the gripper members are in their second position and grippingly engage the opened case blank.

4. The apparatus of claim 3 further characterized in that there is provided control means for operating the gripper members to release their gripping engagement with opened case blank after the folder member has been moved to its second position, operate the third means to open the case blank before the folder member is moved to its second position, and actuate the fourth means to move the third means toward the frame front end portion after the gripper members have released the opened case blank and the folder member is in its second position.

5. The apparatus of claim 3 further characterized in that the third means includes fifth means for abutting against one of the minor side walls to open the case blank and move the opened case blank forwardly along the means for supporting a case in an opened condition, and means for abutting against the other minor side wall to in cooperation with the fifth means retain the case blank in an opened condition as the case blank is moved forwardly.

6. The apparatus of claim 3 further characterized in that there is provided means on the frame for folding the other minor flap toward said adjacent minor flap and partially fold the major flaps toward one another to hold the minor flaps in their folded condition, means for applying adhesive to the flaps after the minor flaps have been folded to adhere the major flaps to the minor flaps when the major flaps are completely folded, and means for completing the folding of the major flaps to adhere them to the minor flaps after the adhesive has been applied.

7. The apparatus of claim 1 further characterized in that there is provided fifth means for limiting the angular movement of the lower minor side wall relative the upper major side wall to an angle of about 90 degrees as the upper minor side wall is folded, the fifth means being mounted on the fourth means.

8. The apparatus of claim 7 further characterized in that the fourth means includes a carriage, sixth means mounting the carriage for movement between a first position adjacent the location of the gripping means when the gripping means has moved a gripped blank away from the stack, and a second position remote from the carriage first position, seventh means for mounting the third means on the carriage for movement therewith, eighth means for mounting the fifth means on the carriage for movement therewith, and operable means for moving the carriage between its positions.

9. The apparatus of claim 8 further characterized in that the third means includes a side wall folding member and that the seventh means includes means for moving the folding member between a retracted position relative the carriage and an extended position to abut against the upper minor side wall of the gripped blank in its generally right angular position relative the upper major side wall.

10. The apparatus of claim 8 further characterized in that the fifth means includes a lower minor side wall abutting member and that the eighth means includes means for moving the last mentioned abutting member between a retracted position and a second position extending further downwardly and more closely adjacent the folding member than in its retracted position.

11. The apparatus of claim 10 further characterized in that the gripping means includes operable gripper members for releasably gripping the upper major side wall, means for moving the gripper members between a first position for grippingly engaging a blank on the stack and a second position at a higher elevation than the stack, and that the means for aidingly supporting an opened case blank includes means on the frame for permitting the passage of the folded blank from the gripper first position to the gripper second position and abutting against the lower major side wall when the folder member and the said last mentioned abutting member are in their second positions to support the case blank after the gripper members have released their gripping engagement with the case blank.

12. The apparatus of claim 8 further characterized in that the means for supporting an opened case includes elongated lower slide means mounted on the frame for supporting the opened case blank in a position to be pushed therealong by the third means as the carriage moves from its first position to its second position, and upper elongated means vertically above the slide means for abutting against the case blank, and that the fourth means mounted on the frame for mounting the carriage mounting means and the upper elongated means for movement for vertically adjustably positioning the carriage and the upper elongated means, and that the second means includes a plurality of case blank gripping members, means for mounting the gripping members in adjusted horizontally spaced positions, and means mounted on the frame for mounting and moving the gripping members mounting means between a position the gripper members abut against the top case blank on the stack and an elevated second position.

13. The apparatus of claim 12 further characterized in that the first means includes a conveyor assembly having an upper run to support a plurality of horizontally spaced stacks of blanks and that there is provided control means to operate the conveyor assembly to move the upper run in a direction to move a stack of blanks beneath the gripper members when there are no blanks therebeneath.

14. For opening a case blank and sealing opposed first and second flaps to the opposed third and fourth flaps at one end of an opened case blank, a case opening and sealing machine comprising a frame that includes a longitudinally elongated frame having a front end portion and a rear end portion, first means mounted on the frame rear end portion for supporting a plurality of flat folded case blanks, operable second means mounted on the frame rear end portion for movement from a lowered position to an elevated position for lifting a blank from the first means, longitudinally elongated slide third means for supporting a case blank in an open condition, said slide means extending longitudinally from vertically adjacent the first means to the frame front end portion, fourth means for cooperating with the lifting means and the slide means for opening the case blank and moving the opened case blank forwardly along the slide means, fifth means for cooperating with the fourth means to aid in retaining the open case blank in an elevated condition prior to the open case blank being moved along the slide means, sixth means for folding the first and second flaps of the lifted case blank inwardly toward one another and then partially fold the third and fourth flaps through substantial angles that are substantially less than 90° to converge inwardly toward one another to retain the first and second flaps in a fold condition as the case blank is moved forwardly, seventh means for applying an adheisve to at least some of said flaps on areas of the flaps to adhere the third and fourth flaps to the first and second flaps when the folding of the third and fourth flaps has been completed, operable eighth means mounted on the frame front end portion to complete the folding of the third and fourth flaps and compress the folded flaps, and control means for operating the lifting means to lift a case blank from the first means, the fourth means to cooperate with lift means to open the case blank and then move the open case blank forwardly along the slide means, the lift means to release the case blank prior to the case blank being moved adjacent the frame front end portion, the adhesive applying means to apply adhesive and after the adhesive has been applied, and the case blank is at the frame front end portion, operate the eighth means to complete the folding of the third and fourth flaps.

15. The apparatus of claim 14 further characterized in that the fourth means includes a carriage, means mounting the carriage on the frame for movement from a position adjacent the first means to a position adjacent the frame front end portion, and erecting means mounted on the carriage for movement therewith and relative thereto to open the lifted blank and cooperate with the fifth means to support the opened case blank prior to the case blank being moved forwardly along the slide means.

16. The apparatus of claim 15 further characterized in that the control means includes means for operating the lift means to release the case blank prior to the case blank being moved forwardly along the slide means, and after the lift means releases the supported case blank, move the carriage toward the frame front end portion.

17. The apparatus of claim 16 further characterized in that the slide means includes a lower, longitudinally elongated slide member having a rear terminal end portion vertically adjacent the first means and that the fifth means includes latch means mounted on the slide member rear terminal end portion for movement from a datum position by a case blank being elevated to permit the case blank being moved vertically thereabove and upon the case blank being moved thereabove, automatically return to its datum position, said latch means being mounted on the slide member in a position to supportingly engage the open elevated case blank prior to the case blank being moved longitudinally forwardly by the fourth means.

18. The apparatus of claim 16 wherein the case blank in an open condition has generally vertical front and rear side walls with the first flap joined to the rear side wall and the second flap joined to the front side wall, further characterized in that erecting means includes a rear vertically elongated erecting member and means for mounting the erecting member on the carriage in a position to abut against the rear side wall of the blank in an open condition.

19. The apparatus of claim 18 further characterized in that the erecting means includes a front erecting member and means for mounting the front erecting member on the carriage in a position to abut against the case front wall when the case blank is in an open condition.

20. The apparatus of claim 19 further characterized in that the second means includes a plurality of vacuum cups, means for mounting the vacuum cups in horizontal spaced relationship, and means on the frame for moving the vacuum cups between a lowered blank pick-up position and an elevated position, and that the means for mounting the rear erecting member includes means mounted on the carriage for moving the rear erecting member between an elevation higher than the vacuum cups in their elevated position and an elevation that the erecting member extends to a substantially lower elevation than the vacuum cups in their elevated position.

21. The apparatus of claim 20 further characterized in that the carriage is mounted for movement to a carriage rear position that the rear erecting member is rearwardly of the vacuum cups, and that the control means includes means operating the rear erecting member moving means to its higher elevation when the carriage is at the frame front end portion, and to lower the rear erecting member when the carriage is at the frame rear end portion and the vacuum cups are in their elevated position to open the gripped case blank.

22. The apparatus of claim 20 further characterized in that the sixth means includes a longitudinally extending folder blade and operable means mounted on the frame for moving the folder blade between a datum retracted position rearwardly of an elevated open case blank first flap and an extended position to fold the first flap toward the second flap.

23. The apparatus of claim 22 further characterized in that the control means includes means for operating the folder blade operable means from the blade retracted position to the blade extended position after the case blank has been opened and prior to the case blank being released by the lift means.

24. The apparatus of claim 22 further characterized in that the eighth means includes a backing plate, means for mounting the backing plate on the frame forwardly of the sixth means and moving the backing plate transversely between a datum position to retain the third and fourth flaps in their converging folded relationship as the case blank is moved forwardly and a second position more closely adjacent the slide means to complete the folding of the third and fourth flaps, a press plate and means for moving the press plate transversely between a datum position and a position closely adjacent the backing plate in its second position to compress the first through fourth flaps between the press plate and the backing plate, the press plate being of a size for being moved into the opened case blank.

25. The apparatus of claim 24 further characterized in that the slide means includes a lower, longitudinally elongated slide member, an upper longitudinally elongated slide member, said slide members extending longitudinally between the press plate and the backing plate in their datum positions, and longitudinally elongated stop means located on the side of the slide members transversely opposite the backing plate to limit the transverse movement of the erected case blank transversely in a direction away from the backing plate.

26. The apparatus of claim 25 further characterized in that there is provided means on the backing plate and the slide means to retain the open case blank in an erect position at the forward end portion of the frame, and that the control means includes means for automatically operating the press plate and backing plate moving means to move said plates to compress the first through fourth flaps after the case has been moved to the forward end portion of the frame.

27. For opening a flat folded case blank having a pair of minor side walls joined at fold lines to opposed edges of a pair of rectangular major side walls, a case opening machine that includes a frame, means on the frame for supporting a stack of said blanks in vertical stacked relationship with each blank having an upper major and minor side walls above a lower major and minor side wall, means for releasably gripping the upper major side wall of a blank on the top of said stack, operable means on the frame for moving the gripping means between a blank gripping first position and a second position at a substantially higher elevation than the gripping position, means for engaging the upper minor side wall to fold it to extend downwardly at generally right angles to the upper side wall, operable means moving the folding means from a first position at a higher elevation than the case blank in the gripping means second position and a second lower position, and control means for operating the gripping means moving means to move the gripping means to grip the top blank on the stack of blanks and then to its second position and thereafter operate the folding means operable means to move the folding means from the folding means first position to the folding means second position to open the case blank while it is gripped by the gripping means and means for mounting the operable means on the frame.

28. The apparatus of claim 27 wherein the case blank includes upper and lower major and minor flaps joined to the upper and lower major and minor side walls respectively along fold lines, further characterized in that there is provided a folding blade, operable means for moving the folding blade between a datum position spaced from the adjacent minor flap of a case blank gripped by the gripping means with the gripping means in its second position and an adjacent minor flap folding position vertically between the major flaps to fold the adjacent minor flap as the folding blade is moved from its datum position to its second position, the control means including means for operating the folding blade operable means to move from its datum position to its second position after the side wall folding means has been moved to its second position and while the blank is gripped by the gripper means.

29. The apparatus of claim 27 further characterized in that there is provided case erect means abuttable against the lower minor side wall to limit the movement of the lower minor side wall to a position extending downwardly relative the upper major side wall as the upper minor side wall is moved to its generally right angle position.

30. The apparatus of claim 29 further characterized in that there is provided means for supportingly engaging the lower major side wall to in cooperation with the erect and folding means retain the open case blank in an elevated position even after the gripping means releases the gripped blank, the control means including means to operate the gripping means to release the blank after the folding means has moved to its lower position.

31. The apparatus of claim 30 further characterized in that the means for mounting the operable means includes a carriage, means mounted on the frame for mounting the carriage for movement from a first position above the stack support means and a second position remote from its first position, and operable means on the frame for moving the carriage between its positions, the operable means for the side wall folding and erect means being mounted on the carriage for movement therewith and moving the folding and erect means relative thereto, the side wall folding means being more remote from the carraige second position than the erect means when the carriage is in its first position, the control means including means for operating the carriage moving means to move the carriage from its first position to its second position after the gripped blank has been released and while the folding means is in its second position.

32. The apparatus of claim 31 further characterized in that there is provided slide means for supporting the open case blank in an open condition to be moved by the folding means as the carriage moves from adjacent the support means with the folding means in its second position, the means for operating the folding means including means for operating the folding means to its first position when the carriage is moved to its second position.

33. For folding and sealing opposed minor first and second flaps, which are respectively joined along fold lines to the one transverse ends of the first and second minor side walls of a case blank, to opposed major third and fourth flaps, which are respectively joined along fold lines to the one transverse ends of major third and fourth side walls, the case blank having minor fifth and sixth flaps joined along fold lines to the respective transverse opposite ends of the first and second side walls and major seventh and eighth flaps joined along fold lines to the respective transverse opposite ends of the third and fourth side walls, each of said flaps having a longitudinally extending terminal edge substantially parallel to the respective fold line and substantially spaced therefrom, a folding and sealing machine that includes a longitudinally elongated frame having a rear end portion and a front end portion, longitudinally elongated lower slide means extending from a location remotely rearwardly of the frame front end portion to the frame front end portion for supportingly engaging the case third side wall, longitudinally elongated upper slide means vertically above the lower slide means and extending from a location remotely rearwardly of the frame front end portion to the frame front end portion for bearing against the case fourth side wall, means mounted on the frame for supporting a case in an open condition with the fourth side wall vertically above the third side wall, the first and second side walls extending generally perpendicular to the third and fourth side walls and flaps extending transversely outwardly of the side walls, and moving the case forwardly along and between the slide means to the frame front end portion, means on the frame for folding the first flap through an angle of about 90 degrees to extend toward the second flap, means on the frame for first folding the second flap through an angle of about 90 degrees to extend toward the first flap and then folding the third and fourth flaps through angles substantially less than 90 degrees to converge toward one another to retain the first and second flaps in their folded condition as the case is moved along the slide means, plate means on the frame forwardly of the means for folding the first and second flaps and convergingly folding the third and fourth flaps for folding the third and fourth flaps from their converging fold relationship to extend toward one another at about right angles to the third and fourth walls, respectively, when the case blank is at the front end portion of the frame, means for applying adhesive on one of the first and second flaps, and the third and fourth flaps, for adhering the one to the other after the third and fourth flaps have been folded to their about right angle positions, a press plate of a size to be extended into the open case blank and abut against the folded first and second flaps, and means mounted on the frame front end portion for mounting the press plate and moving the press plate from a datum position on the transverse opposite side of the slide means from the plate folding means, and a press position within the case abutting against the first and second flaps to exert a compressive force to the first through fourth flaps between the press plate and the plate folding means.

34. The apparatus of claim 33 further characterized in that the case blank moving means includes a vertically extending first member abuttable against the first side wall for pushing the case blank along the slide means, a second member abuttable against the second side wall to aid in retaining the case blank in an open condition and means mounted on the frame for moving said members forwardly in abutting relationship with a case in an opened condition including the first members to push the opened case blank along the slide means.

35. The apparatus of claim 34 further characterized in that the last mentioned means includes a carriage, means mounted on the frame for longitudinally reciprocating the carriage between a rearward position and a position at the front end portion of the frame, and means for moving the second member to a higher elevation than the case blank on the slide means after the case blank has been moved to the frame front end portion.

36. The apparatus of claim 33 further characterized in that the plate folding means including a vertical, longitudinally elongated backing plate, and means mounted on the frame for mounting the backing plate at the front end portion of the frame for transverse movement between a datum position that the backing plate abuts against the third and fourth flaps to retain the flaps in their converging folded relationship as the case blank is moved forwardly of the third and fourth flap converging folding means and a second position transversely more closely adjacent the slide means for folding the third and fourth flaps to their about 90° folded positions.

37. The apparatus of claim 36 further characterized in that there is provided longitudinally elongated stop means for abutting against the terminal edge of at least one of the fifth through eighth flaps to limit the maximum transverse spacing of the fifth through eighth flap terminal edges from the slide means as the case is moved along the slide means.

38. The apparatus of claim 37 further characterized in that the second flap and third and fourth flap converging folding means includes a second flap folding blade stationarily mounted on the frame for folding the second flap as the case blank is moved along the slide means, and folder blades stationarily mounted for folding the third and fourth flaps to converge toward one another as the case moves along the slide means, the folder blades converging toward one another forwardly of the second flap folding blade.

39. In a method of forming a bottom sealed case from a flat folded case blank having opposed minor first and second flaps respectively joined to one transverse ends of first and second minor side walls and opposed major third and fourth flaps respectively joined to major third and fourth side walls, the first and second side walls being joined to third and fourth side walls along fold lines and the third and fourth flaps having terminal edges parallel to the fold lines at their juncture to the major side walls, the steps of opening the flat case blank to a generally rectangular configuration with the minor side walls being generally perpendicular to the major side walls, the minor flaps generally parallel to one another and the major flaps generally parallel to one another, folding the minor flaps of the opened case blank to extend inwardly toward one another, then partially folding the major flaps through angles sufficiently great to retain the minor flaps in their folded condition, the partial folding step comprising folding the major flaps through substantial angles that are substantially less than 90° to converge toward one another in a direction away from the side walls, and then mechanically applying a force along substantially the entire length of both of said terminal edges of the partially folded flaps for moving the major flaps toward their completely folded condition.

40. The method of claim 39 further characterized in that the mechanically applying a force step comprises moving both the major flaps at the same time through substantially equal angular increments.

41. The method of claim 39 further characterized in applying an adhesive to some of the flaps while the minor flaps are being retained in their folded condition by the partially folded major flaps in areas for adhesively adhering the major flaps to the minor flaps when the folding of the major flaps has been completed.

42. In a machine for erecting and folding a flat folded case blank having a pair of rectangular major side walls, a pair of rectangular minor side walls joined at fold lines to opposed edges of the pair of rectangular major side walls, major flaps joined to the major side walls and minor flaps joined to the minor side walls, an elongated frame having a rear end portion and a front end portion, first means at the frame rear end portion for supporting a plurality of said flat folded blanks, second means mounted on the frame for grippingly engaging one major side wall of a flat folded blank on the first means, moving the gripped blank to a blank opening position remote from the first means, and after the gripped blank is opened, release the gripped blank, third means on the frame for opening the gripped blank, and after the gripped blank is opened and released, move the opened blank forwardly to the frame front end portion, and fourth means cooperating with the third means to retain the opened blank in an opened condition and support the opened blank as it is moved forwardly by the third means, the third means including an erecting member and fifth means on the frame for mounting the erecting member and moving the erecting member to abut against a minor side wall of the gripped blank to move the last mentioned side wall to extend at about right angles to the gripped side wall, to open the case blank, and after the gripped side wall is released, move the erecting member forwardly in engagement with the said last mentioned side wall to move the opened blank forwardly along the fourth means to the frame front end portion.

43. The apparatus of claim 42 further characterized in that the fifth means includes a carriage, means mounted on the frame for mounting the carriage and reciprocally moving the carriage between the frame rear end portion and the frame front end portion, and sixth means mounted on the carriage for movement therewith for mounting the erecting member and moving the erecting member relative to the carriage between a retracted position and a minor side wall abutting position.

44. The apparatus of claim 43 further characterized in that each of the fifth and sixth means includes a piston cylinder combination.

45. The apparatus of claim 42 wherein the major flaps have terminal edges remote from the major side walls to which they are joined, further characterized in that there is provided means for folding the minor flaps of the opened case through angles of about 90° to extend inwardly toward one another, means for partially folding the major flaps through substantial angles that are substantially less than 90° as the opened case is moved forwardly to retain the folded minor flaps in their folded condition, means for applying adhesive prior to the completion of the folding of the major flaps to at least two of the flaps in areas to adhere the major flaps to the minor flaps when the major flaps are completely folded; and means at the frame front end portion for abutting against the terminal edges of the partially folded major flaps and moving the partially folded flaps to their completely folded condition to adhere the major flaps to the minor flaps.

46. The apparatus of claim 45 further characterized in that the means for abutting against the terminal edges includes a backing plate and means mounted on the frame for mounting the backing plate and moving the backing plate from a datum position abutting against the terminal edges of the partially folded major flaps as the opened blank is moved forwardly and when the opened blank is stationary at the forward end portion of the frame, move the backing plate to complete the folding of the major flaps, the third means discontinuing the movement of the opened blank when the opened blank is in a position to have the folding of the major flaps completed.

* * * * *

UNITED STATES PATENT AND TRADEMARK OFFICE

CERTIFICATE OF CORRECTION

PATENT NO. : 4,133,254

DATED : Jan. 9, 1979

INVENTOR(S) : Robert E. Odom & Gaylerd M. Lieder

It is certified that error appears in the above-identified patent and that said Letters Patent are hereby corrected as shown below:

Column 9, line 36, change "292" second occurrence to -- 293 --.
Column 20, line 45, after "means" insert --includes means--.

Signed and Sealed this

*Eighth* Day of *May 1979*

[SEAL]

*Attest:*

RUTH C. MASON
*Attesting Officer*

DONALD W. BANNER
*Commissioner of Patents and Trademarks*